US006416446B1

(12) United States Patent
Krull

(10) Patent No.: US 6,416,446 B1
(45) **Date of Patent: *Jul. 9, 2002**

(54) SELECTORIZED DUMBBELL

(76) Inventor: Mark A. Krull, 1705 E. Ridge Ct., Northfield, MN (US) 55057

( * ) Notice: Subject to any disclaimer, the term of this patent is extended or adjusted under 35 U.S.C. 154(b) by 0 days.

This patent is subject to a terminal disclaimer.

(21) Appl. No.: 09/246,825

(22) Filed: Feb. 8, 1999

Related U.S. Application Data

(63) Continuation-in-part of application No. 08/939,845, filed on Sep. 29, 1997, now Pat. No. 6,033,350.

(51) Int. Cl.[7] ..... A63B 21/075
(52) U.S. Cl. ..... 482/108; 482/98; 482/107
(58) Field of Search ..... 482/50, 93, 94, 482/98, 106–109, 908; D21/680, 681

(56) References Cited

U.S. PATENT DOCUMENTS 1,672,944 A * 6/1928 Jowett ..... 482/108
3,771,785 A * 11/1973 Speyer ..... 482/106
4,529,198 A 7/1985 Hettick, Jr.
4,822,034 A 4/1989 Shields
4,982,957 A 1/1991 Shields
5,257,964 A 11/1993 Petters
5,284,463 A 2/1994 Shields
5,328,428 A 7/1994 Huang
5,344,375 A 9/1994 Cooper
5,637,064 A 6/1997 Olson et al.
5,769,762 A 6/1998 Towley, III
5,839,997 A 11/1998 Roth et al.
5,853,355 A * 12/1998 Standish ..... 482/106
5,879,274 A 3/1999 Mattox
6,033,350 A * 3/2000 Krull ..... 482/108
D422,654 S * 4/2000 Chen ..... D21/681

* cited by examiner

*Primary Examiner*—Mickey Yu
*Assistant Examiner*—Victor Hwang

(57) ABSTRACT

Weights are disposed on opposite sides of a base member, and selector rods are selectively moved into engagement with the desired number of weights on each side of the base member. Upon rotation of a knob, the selector rods move in opposite directions to engage the desired number of weights.

20 Claims, 20 Drawing Sheets

Fig. 15
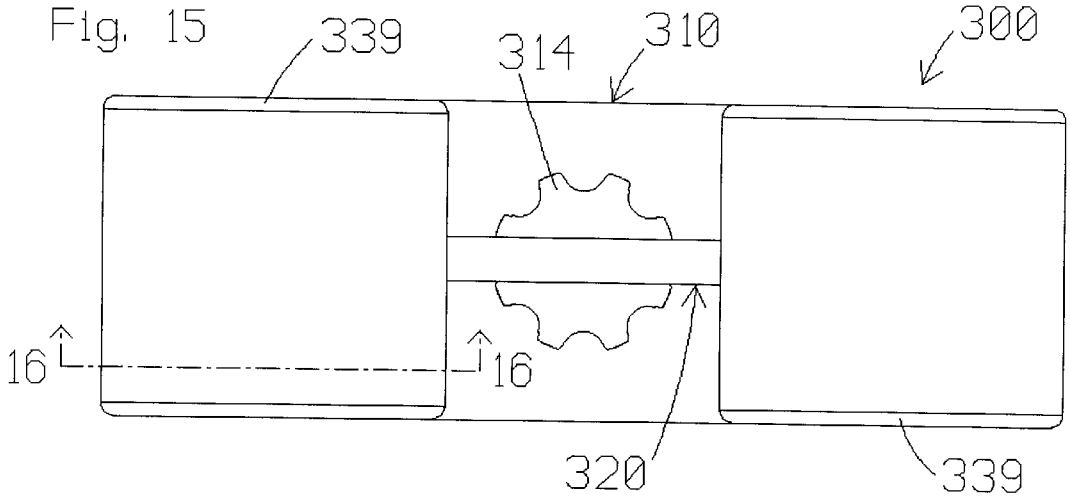
Fig. 16
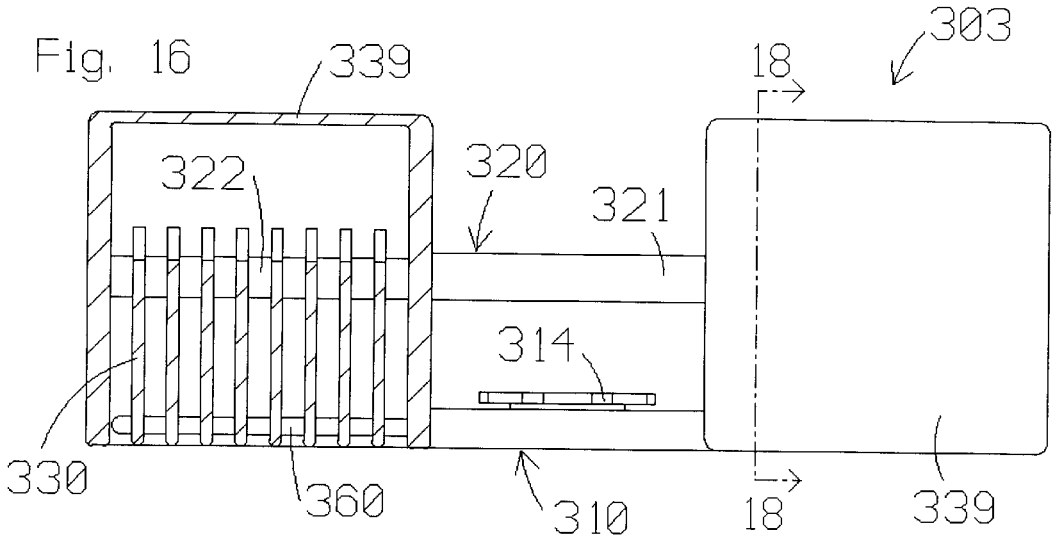
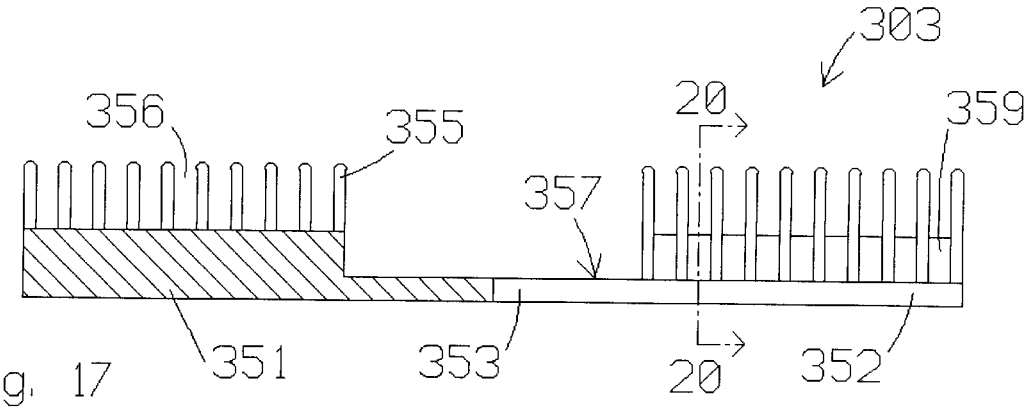
Fig. 17

Fig. 24
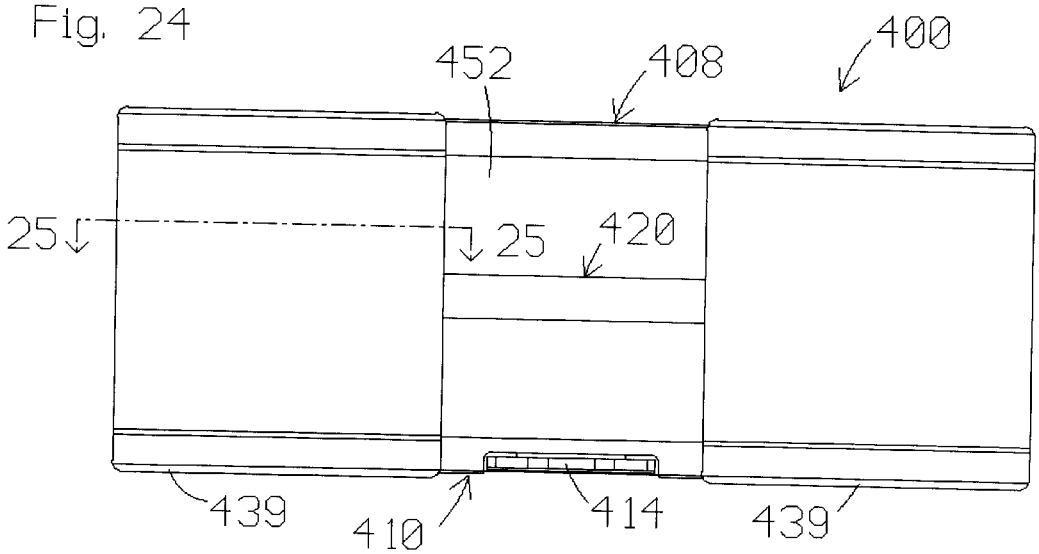
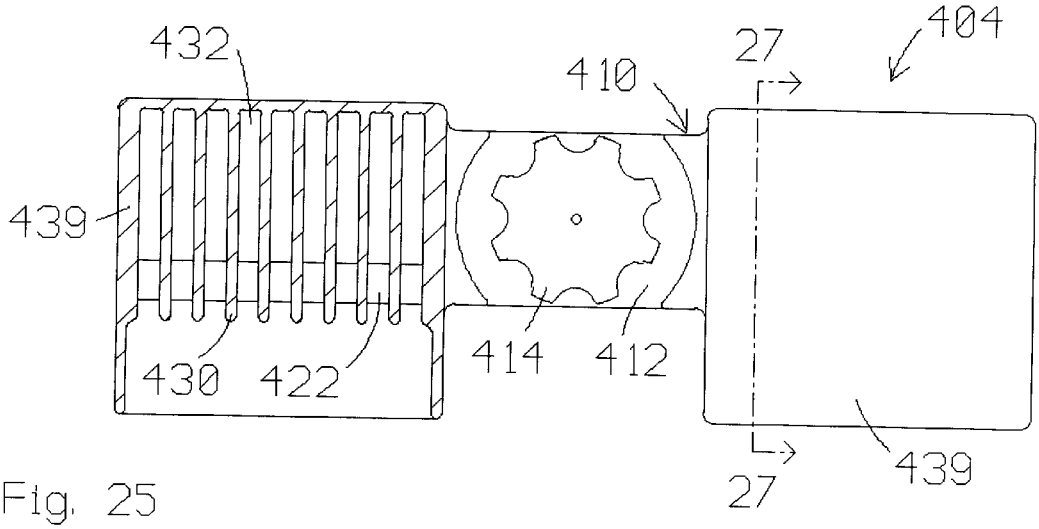
Fig. 25
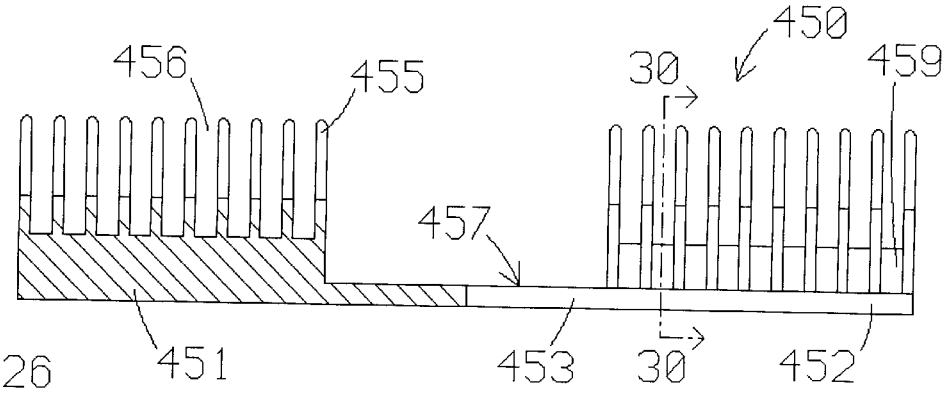
Fig. 26

Fig. 31
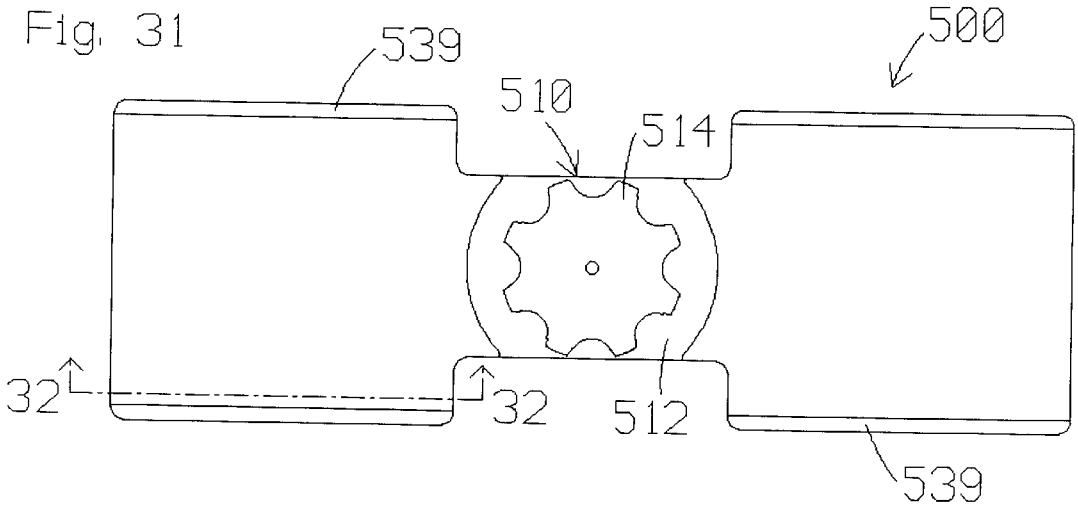
Fig. 32
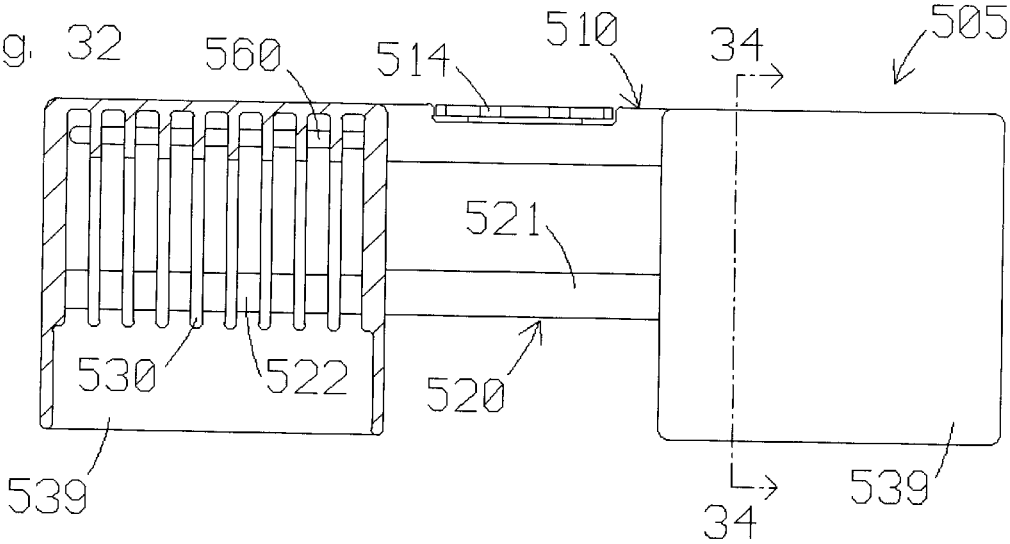
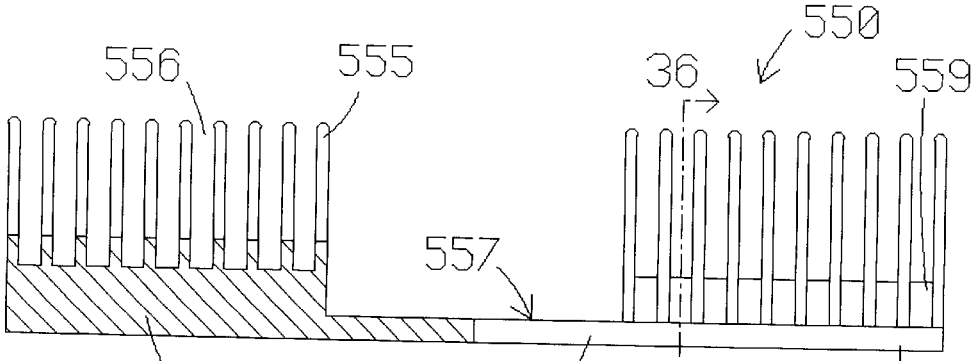
Fig. 33

Fig. 37
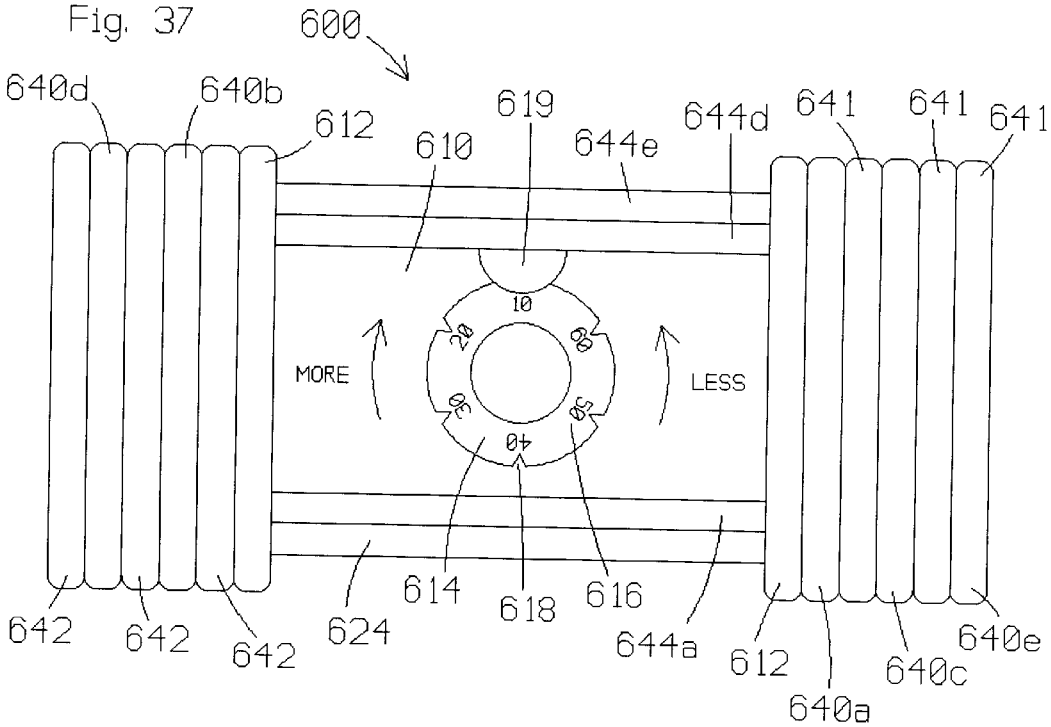
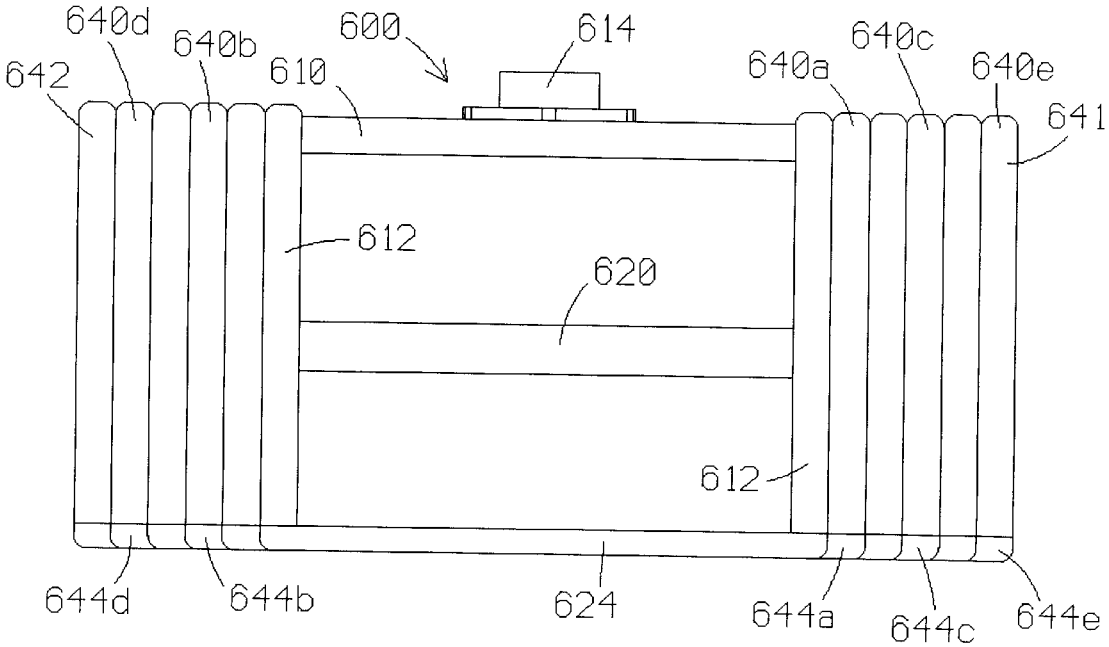
Fig. 38

Fig. 39
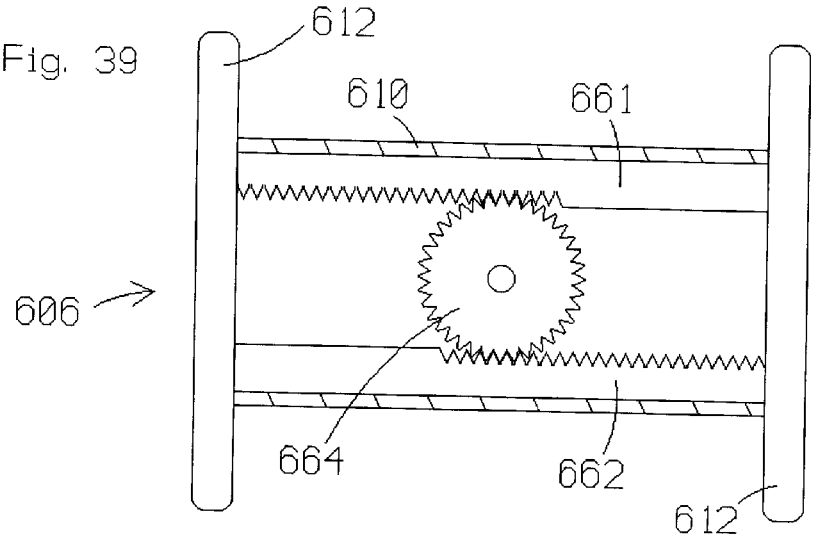
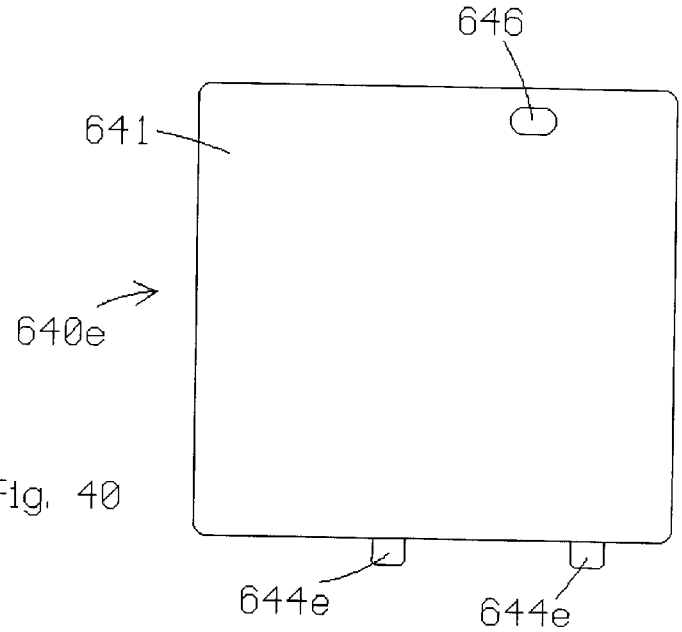
Fig. 40
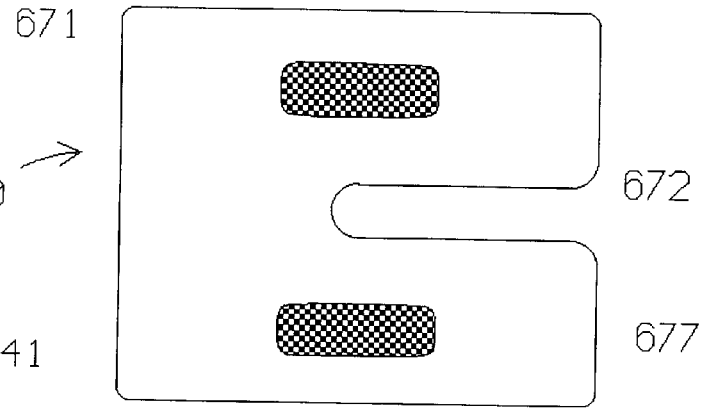
Fig. 41

Fig. 42
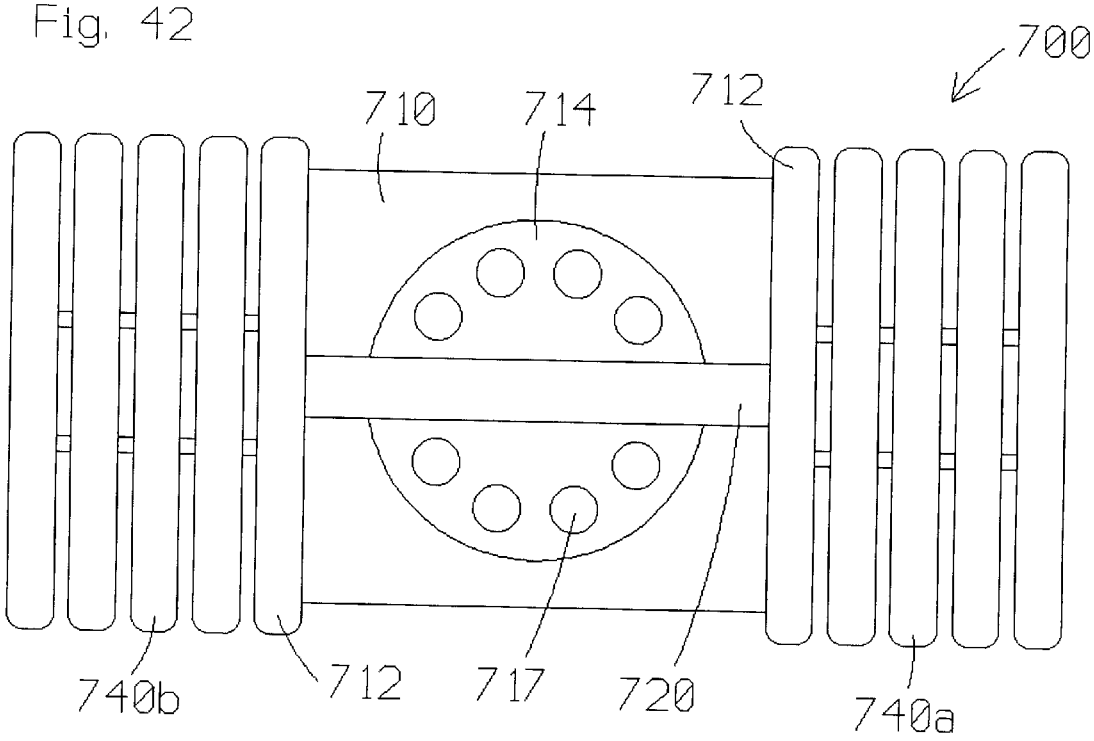
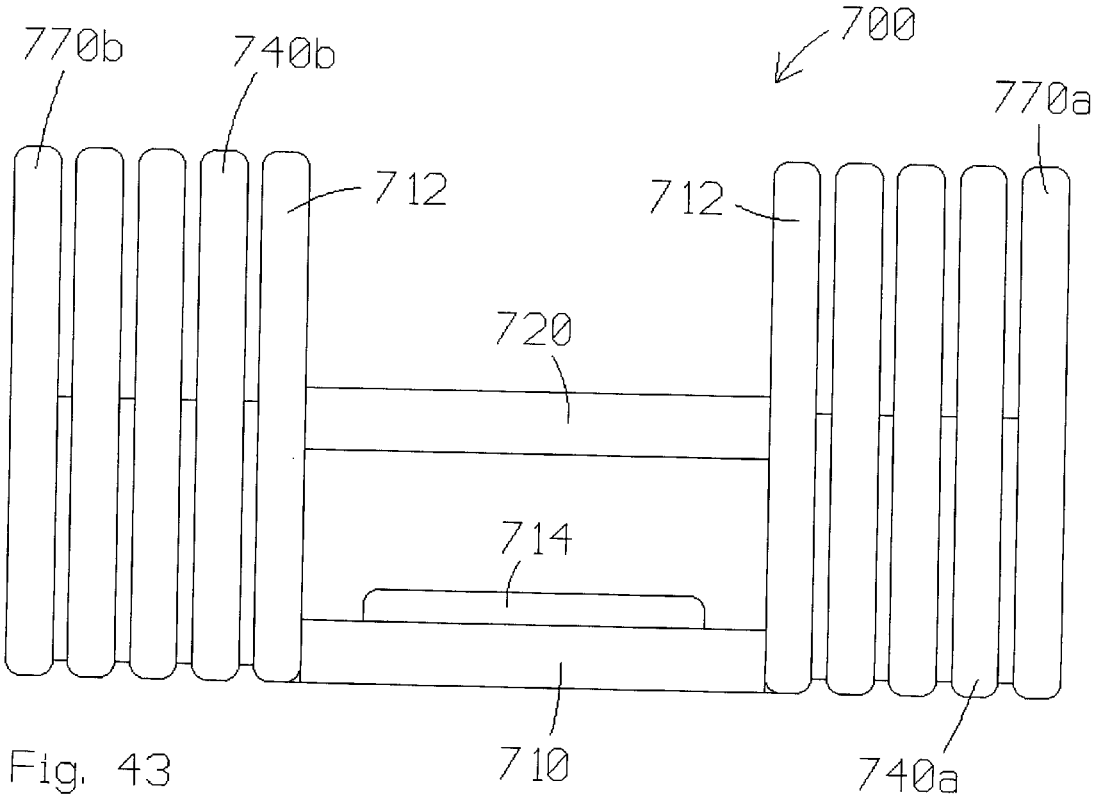
Fig. 43

Fig. 49
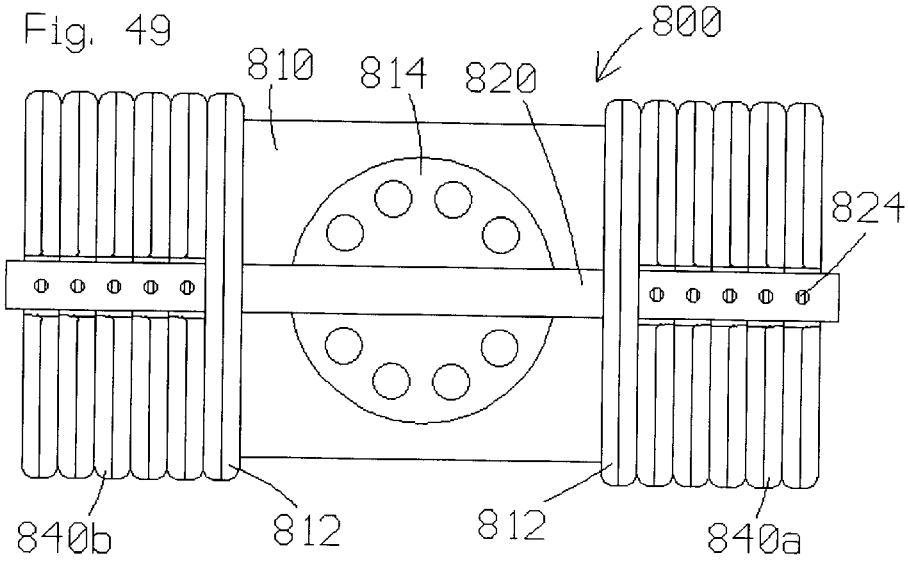
Fig. 50
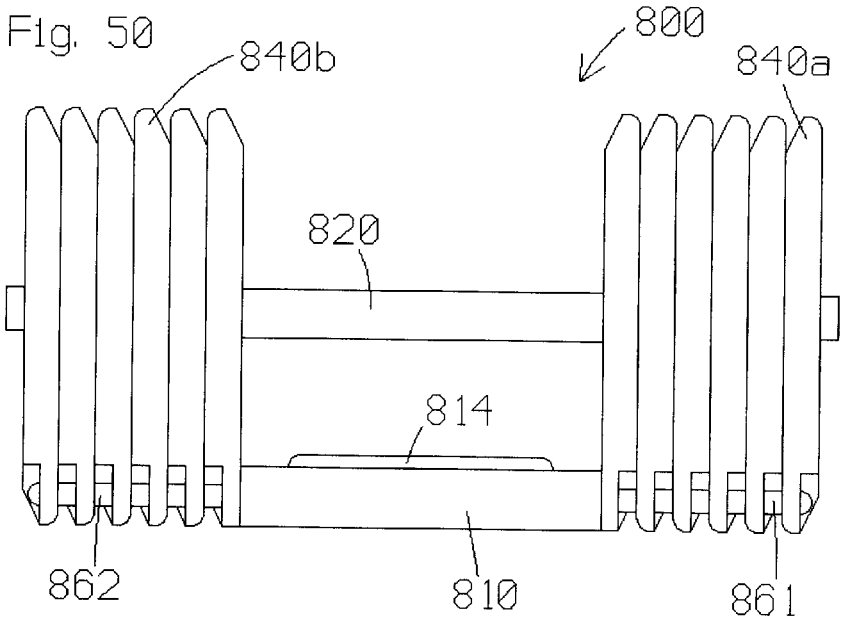
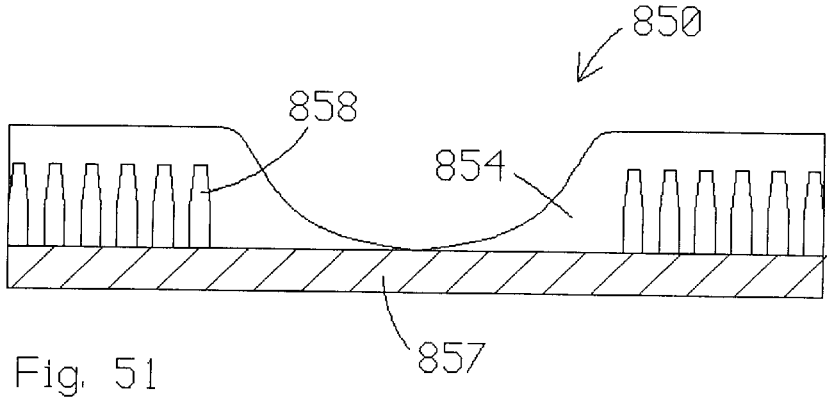
Fig. 51

Fig. 57
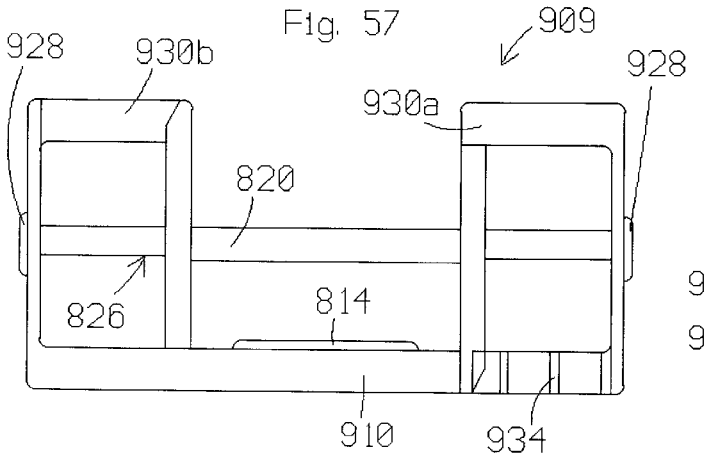
Fig. 58
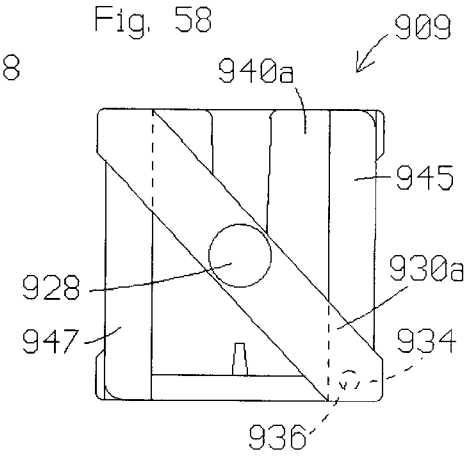
Fig. 59
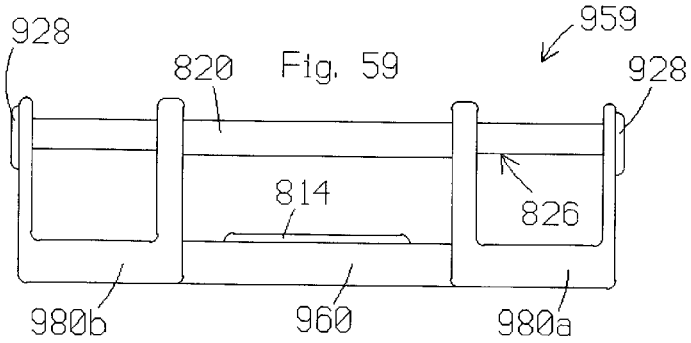
Fig. 60
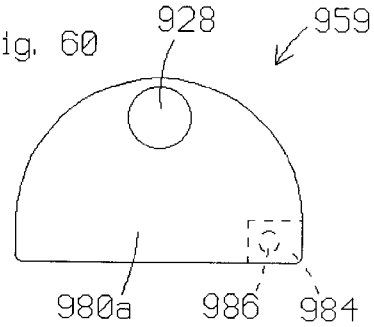
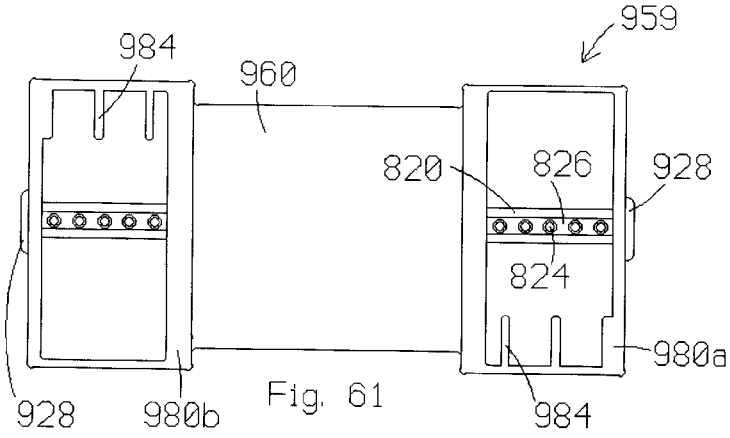
Fig. 61

SELECTORIZED DUMBBELL

CROSS REFERENCE TO RELATED APPLICATION

This application is a continuation-in-part of U.S. patent application Ser. No. 08/939,845, filed on Sep. 29, 1997 now U.S. Pat. No. 6,033,350.

FIELD OF THE INVENTION

The present invention relates to exercise equipment and more particularly, to weight-based resistance to exercise movement.

BACKGROUND OF THE INVENTION

Exercise dumbbells are well known in the art and prevalent in the exercise equipment industry. Generally speaking, each dumbbell includes a handle and a desired number of weights or plates which are typically secured to opposite sides of the handle. The dumbbell is lifted up subject to gravitational force acting on the mass of the handle and any attached weights.

Some prior art dumbbells are made as fixed weights. Some people prefer fixed weight dumbbells, perhaps because they are simple to use and solid in construction. However, a disadvantage of fixed weight dumbbells is that a set of numerous fixed weight dumbbells is required to obtain a range of weight resistance.

Other prior art dumbbells include handles and weight plates which the user is able to add to and/or remove from the handles. These variable weight dumbbells provide an economy of scale because only a few weights may be combined in a variety of ways to obtain a range of weight resistance. On the other hand, these variable weight dumbbells require time to change between levels of weight resistance (particularly since a change is typically made to each end of two separate handles), and the weight plates present a storage problem, as well.

Still other prior art, adjustable weight dumbbells (and barbells) do not require the user to handle the weight plates during changeovers, and they also maintain the weight plates in orderly fashion when not in use. Examples of these more sophisticated, "self-adjusting" free weight assemblies are disclosed in U.S. Pat. No. 4,529,198 to Hettick, Jr. (discloses a barbell assembly having opposite side weights which are maintained in alignment on respective storage members and selectively connected to a handle by means of axially movable springs); U.S. Pat. No. 4,822,034 to Shields (discloses both barbell and dumbbell assemblies having opposite side weights which are maintained in alignment on a shelf and selectively connected to a handle by means of latches on the weights); and U.S. Pat. No. 5,637,064 to Olson et al. (shows a dumbbell assembly having a plurality of interconnected opposite side weights which are stored in nested relationship to one another and selectively connected to a handle by means of a U-shaped pin).

SUMMARY OF THE INVENTION

The present invention provides exercise dumbbells which "self-adjust"in response to rotation of a knob. Many of the features and advantages of the present invention will become apparent from the detailed description that follows.

BRIEF DESCRIPTION OF THE FIGURES OF THE DRAWING

With reference to the Figures of the Drawing, wherein like numerals represent like parts and assemblies throughout the several views.

FIG. 15 is a top view of another dumbbell assembly constructed according to the principles of the present invention;

FIG. 16 is a partially sectioned side view of a base assembly which is a component of the assembly of FIG. 15;

FIG. 17 is a partially sectioned side view of a cradle which is a component of the assembly of FIG. 15;

FIG. 24 is a top view of yet another dumbbell assembly constructed according to the principles of the present invention;

FIG. 25 is a partially sectioned side view of a base assembly which is a component of the assembly of FIG. 24;

FIG. 26 is a partially sectioned side view of a cradle which is a component of the assembly of FIG. 24;

FIG. 31 is a top view of still another dumbbell assembly constructed according to the principles of the present invention;

FIG. 32 is a partially sectioned side view of a base assembly which is a component of the assembly of FIG. 31;

FIG. 33 is a partially sectioned side view of a cradle which is a component of the assembly of FIG. 31;

FIG. 37 is a top view of still another dumbbell assembly constructed according to the principles of the present invention;

FIG. 38 is a side view of the assembly of FIG. 37;

FIG. 39 is a partially sectioned bottom view of a base assembly which is a component of the assembly of FIG. 37;

FIG. 40 is an end view of a weight member which is a component of the assembly of FIG. 37;

FIG. 41 is an end view of a half-weight plate suitable for use on the assembly of FIG. 37;

FIG. 42 is a top view of still another dumbbell assembly constructed according to the principles of the present invention;

FIG. 43 is a side view of the assembly of FIG. 42;

FIG. 49 is a top view of still another dumbbell assembly constructed according to the principles of the present invention;

FIG. 50 is a side view of the assembly of FIG. 49;

FIG. 51 is a partially sectioned side view of a cradle suitable for use with the assembly of FIG. 49;

FIG. 57 is a side view of an alternative embodiment base assembly suitable for use with the weight plate of FIGS. 52–56;

FIG. 58 is an end view of the base assembly of FIG. 57;

FIG. 59 is a side view of another alternative embodiment base assembly suitable for use with the weight plate of FIGS. 52–56;

FIG. 60 is an end view of the base assembly of FIG. 59; and

FIG. 61 is a bottom view of the base assembly of FIG. 59.

DETAILED DESCRIPTION OF A PREFERRED EMBODIMENT

Figure 1:
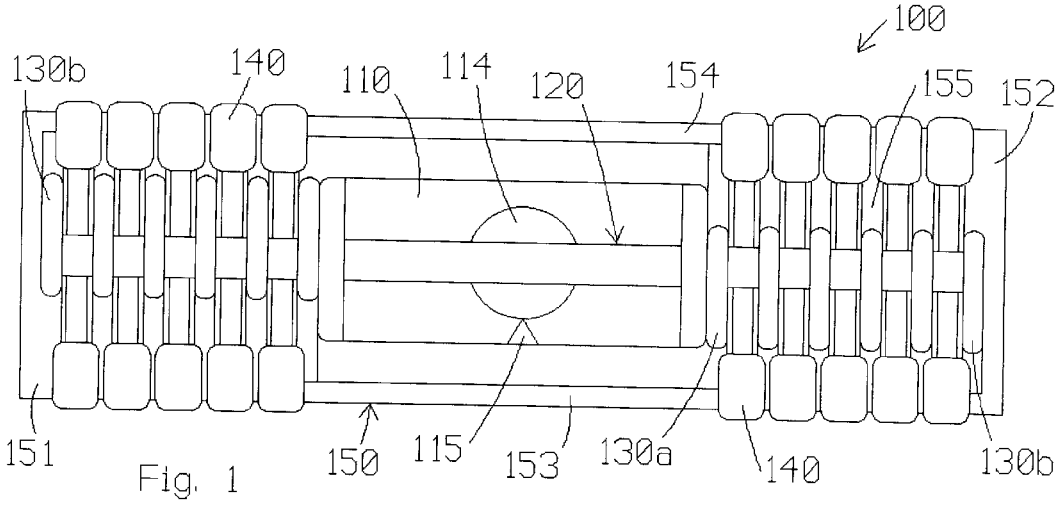
FIG. 1 is a top view of an exercise dumbbell assembly constructed according to the principles of the present invention.
Figure 2:
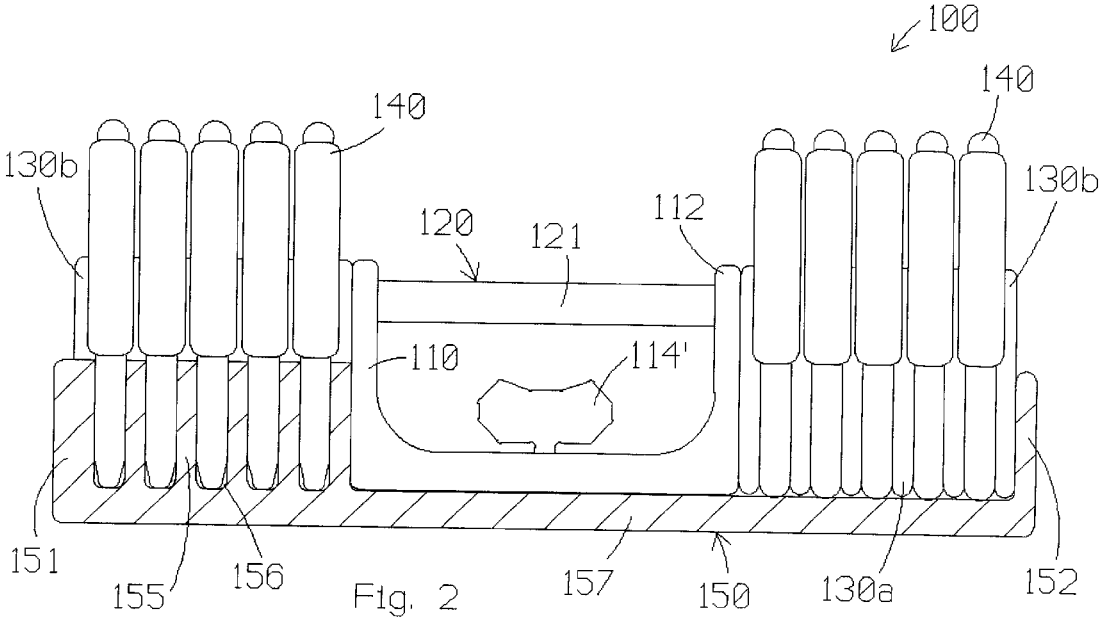
FIG. 2 is a side view of the assembly of FIG. 1.
Figure 3:
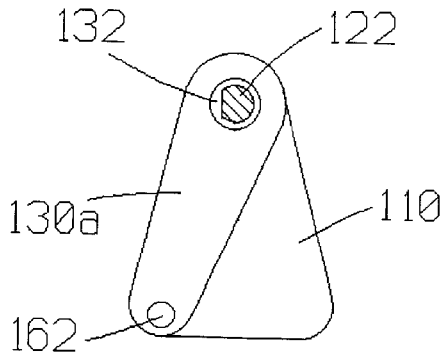
FIG. 3 is an end view of a base assembly which is a component of the assembly of FIG. 1.
Figure 5:
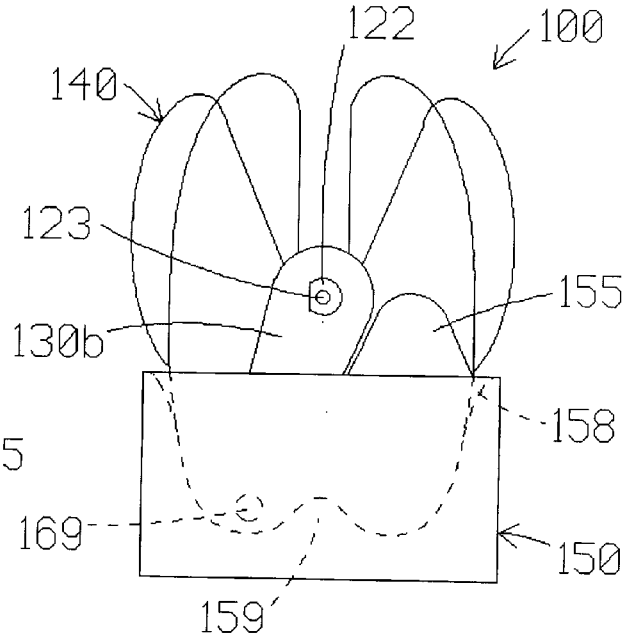
FIG. 5 is an end view of the assembly of FIG. 1.

A first dumbbell assembly constructed according to the principles of the present invention is designated as 100 in FIGS. 1–2 and 5. The dumbbell assembly 100 includes a base member 110, a handle 120, handle spacers 130*a* and 130*b*, weight plates 140, and a cradle 150. The base member 110, the handle 120, and the spacers 130*a* and 130*b* are rigidly secured together and move as a unitary base assembly or handle assembly. The weight plates 140 are selectively connected to the handle assembly via the handle 120, the spacers 130*a* and 130*b*, and selector rods 161 and 162 movably mounted on the base member 110. The weight plates 140 are supported by the cradle 150 when not in use.

Figure 4:
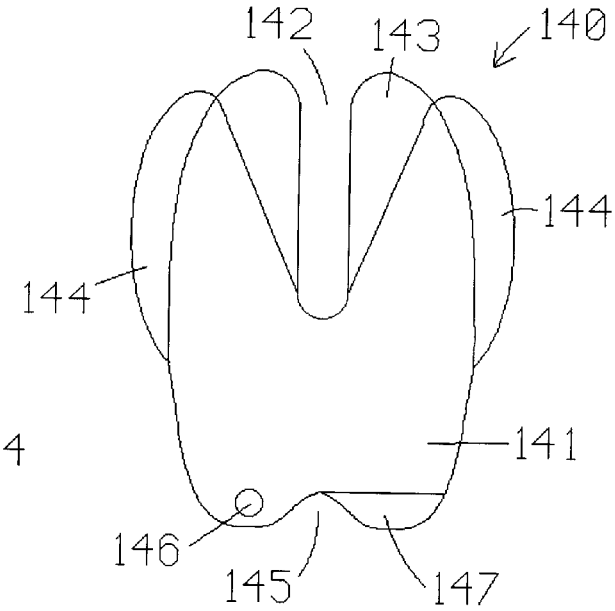
FIG. 4 is an end view of a weight plate which is a component of the assembly of FIG. 1.

One of the weight plates 140 is shown by itself in FIG. 4. The plate 140 is a generally U-shaped mass 141 which is sized and configured to fit between adjacent spacers 130*a* (and 130*b* at the ends of the assembly 100). The mass 141 is provided with an upwardly opening, elongate slot 142 which is sized and configured to receive the handle 120. Upper portions 143 of the mass 141 are upwardly tapered to provide relatively larger gaps between the tops of adjacent weights 140. Relatively thicker ears or shoulders 144 are provided on opposite sides of the mass 141 to establish a proximal relationship between adjacent plates 140 and to define upwardly opening cavities between adjacent plates 140. The bottom of the mass 141 is provided with a notch 145 which is sized and configured to receive a central ridge 159 on the cradle 150. A hole 146 extends through a lower portion of the mass 141, to one side of the notch 145, to receive a respective selector rod 161 or 162 (as further explained below). An opposite lower portion 147 of the mass 141 is downwardly tapered to provide relatively larger gaps between the bottoms of adjacent weights 140.

The cradle 150 includes opposite end walls 151 and 152, opposite sidewalls 153 and 154, and a bottom wall 157 which cooperate to define upwardly opening compartments. The sidewalls 153 and 154 are spaced far enough apart to accommodate the width of the weight plates 140. On opposite end sections of the cradle 150, cradle spacers 155 extend upward from the bottom wall 157 and inward from a respective sidewall 153 or 154 to define slots 156 which are sized and configured to accommodate the depth of the weight plates 140. As illustrated in FIG. 5, the spacers 155 and the spacers 130*a* and 130*b* are sized and configured to occupy mutually exclusive positions within the end profile, because they occupy the same axial positions along the handle 120. The peripheral walls of the cradle 150 are bounded by upwardly diverging interior surfaces 158 which are sized and configured to "funnel" the weight plates 140 into the cradle 150.

A central portion of the cradle 150 is sized and configured to receive the base member 110. The components of the assembly 100 are preferably sized and configured to ensure that (1) the weight plates 140 rest against the bottom wall 157 of the cradle 150; (2) the handle 120 rests against the bottoms of the slots 142 in the weight plates 140 when in the cradle 150; and (3) the weight plates 140 extend further downward than the base member 110 when the dumbbell rests upon a flat surface, such as a floor or table top. As a result, the base member 110 may be supported slightly above the bottom wall 157 of the cradle 150, although such an arrangement is not a necessary element of the subject invention.

The handle 120 is a steel shaft having a central portion 121, which is preferably cylindrical in shape and provided with a knurled outer surface, and opposite end portions 122, which are primarily cylindrical in shape, but interrupted by an axially extending flat surface. The base member 110 has opposite end walls 112 which are mounted on opposite ends of the central portion 121. The end walls 112 may be keyed to the handle 120 directly (by means of a pin and aligned, axially extending notches in the end walls 112 and the handle 120, for example), or the end walls 112 may be keyed to the handle 120 indirectly (by means of bonds formed between the end walls 112 and respective adjacent spacers 130*a*, for example).

Each spacer 130*a* or 130*b* is provided with an axially extending bore which is sized and configured to receive an end portion 122 of the handle 120. The bores cooperate with respective handle portions 122 to lock the spacers 130*a* and 130*b* against rotation relative to the handle 120. On each end of the handle 120, all spacers 130*a*, but not the outermost spacer 130*b*, are provided with an offset or collar 132 having an axial dimension that is slightly greater than the depth of the weight plates 141. Holes 123 are provided in the ends of the handle 120 to receive bolts or end caps that retain the end spacers 130*b* on the ends of the handle 120.

Each spacer 130*a* or 130*b* extends from the handle 120 to an opposite end, which is provided with a relatively smaller, axially extending bore that is sized and configured to receive a respective selector rod 161 or 162. As shown in FIG. 5, an aligned bore 169 extends into in each end wall 151 and 152 of the cradle 150 (from the inside) to similarly receive a respective selector rod 161 or 162.

Figure 6:
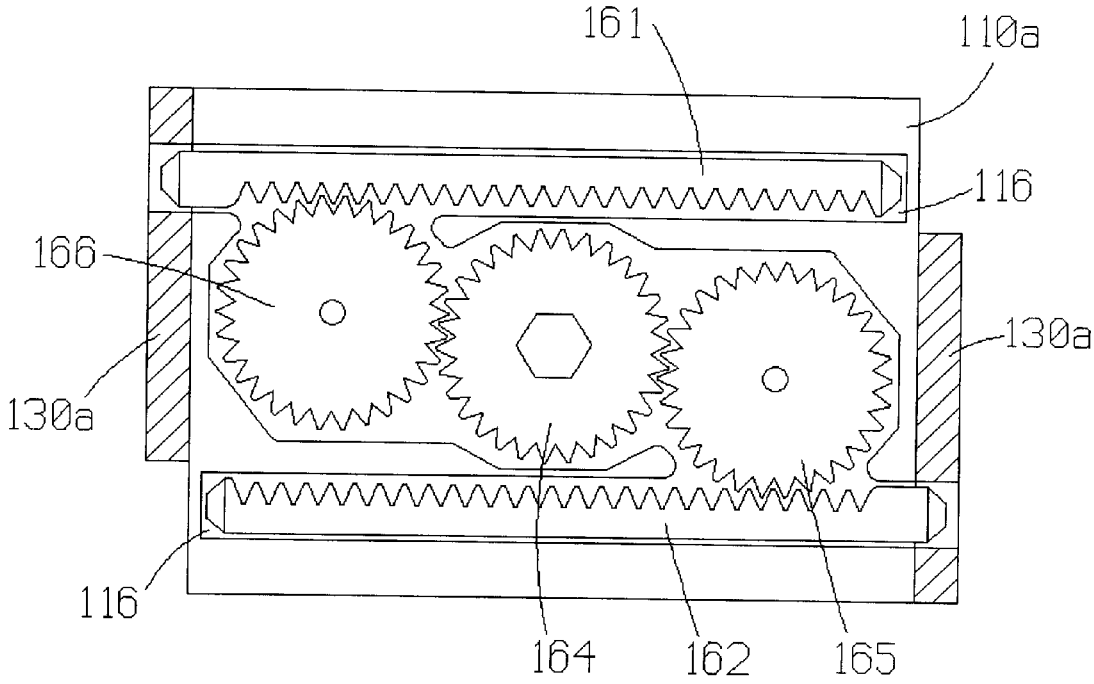
FIG. 6 is a sectioned top view of part of the base assembly of FIG. 3.

As shown in FIG. 6, each selector rod 161 or 162 is a steel bar provided with tapered ends and a rack of gear teeth extending therebetween. Each selector rod is movably mounted in a respective channel 116 formed in a lower portion 110*a* of the base member 110. Respective channels 116 and rods 161 or 162 are axially aligned with the relatively smaller bores through the spacers 130*a* and 130*b* (and with the holes 146 through the weight plates 140 when all of the components are resting in the cradle 150). The rods 161 and 162 are interconnected by a central gear 164 and two pinion gears 165–166, each of which is rotatably mounted to the base member 110. The pinion gear 166 has circumferentially arranged teeth which mate with the gear teeth on the selector rod 161, and the pinion gear 165 has circumferentially arranged teeth which mate with the gear teeth on the selector rod 162. The central gear 164 has similar teeth which mate with the teeth on the pinion gears 165–166.

As shown in FIG. 1, a knob 114 may be rigidly secured to the central gear 164 to enable a user to operate the rack and pinion assembly inside the base member 110. In the alternative, a removable key 114' may be selectively inserted into an opening in the gear 164 in order to rotate same. Any of various known spring detent arrangements may be provided between the knob 114 and the base member 110 and/or between the base member 110 and any of the components of the rack and pinion assembly in order to bias the components to remain in desired orientations/positions relative to the base member 110.

With reference to FIG. 6, rotation of the central gear 164 in the clockwise direction results in counterclockwise rotation of the pinion gears 165–166, thereby driving the rods 161 and 162 in opposite directions, outward from the base member 110, and into engagement with respective spacers 130*a* and weight plates 140. A nearly complete revolution of the knob 114 drives the rods 161 and 162 through respective spacers 130*b* and into the bores 169 in respective end walls 151 and 152 of the cradle 150. In this fully extended configuration, the entire assembly 100 may be lifted by the handle 120. Each channel 116 has an open end proximate the gear 165 or 166 which engages a respective rod 161 or 162, and each channel has an opposite, closed end to resist excessive rotation of the gear 164 in the counterclockwise direction.

Indicia may be provided on the knob 114 and/or the base member 110 to assist a user in selecting a desired amount of weight. For example, the user may simply rotate the knob 114 until the appropriate weight indicator aligns with a pointer 115 on the base member 110. The detent arrangement provides sensory feedback to indicate when the rods 161 and 162 have passed approximately halfway through each of the spacers 130*a* and 130*b*, thereby signalling that an additional pair of weight plates 140 has been engaged. After the desired amount of weight has been selected, the user pulls the handle assembly upward out of the cradle 150. The cradle 150 may be secured to a stand or otherwise anchored to facilitate removal of the handle assembly. The selected weight plates 140 are axially retained between adjacent spacers 130*a* and sometimes 130*b*, and are radially retained by and between the handle 120 and a respective selector rod 161 or 162.

Figure 7:
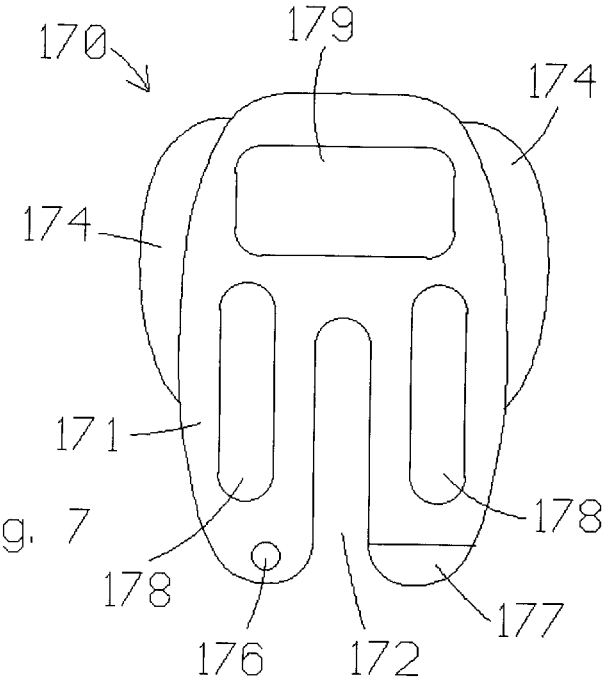
FIG. 7 is an end view of a half-weight plate suitable for use with the assembly of FIG. 1.
Figure 8:
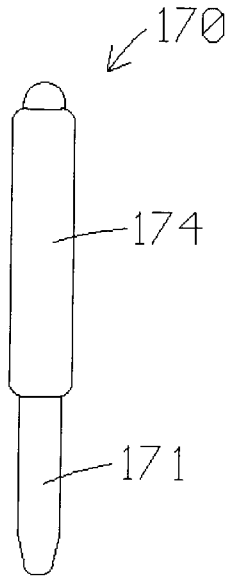
FIG. 8 is a side view of the plate of FIG. 7.

With a handle assembly weighing five pounds, and weight plates 140 weighing five pounds each, the depicted assembly 100 provides a dumbbell capable of weighing five to fifty-five pounds in ten pound increments. Recognizing that different people are likely to require different weight options, the assembly 100 may be modified or complemented to accommodate different weight ranges and/or incremental adjustments. For example, FIGS. 7–8 show a half-weight plate 170 which is sized and configured to replace any of the plates 140 in the assembly 100.

The plate 170 is a generally U-shaped mass 171 which is sized and configured to fit between adjacent spacers 130*a* (and 130*b* at the ends). Unlike the plates 140, the mass 171 is provided with a downwardly opening, elongate slot 172 which is sized and configured to receive the handle 120. As on the plates 140, relatively thicker ears or shoulders 174 are provided on opposite sides of the mass 171 to establish a proximal relationship between the plate 170 and any adjacent plates 140. A hole 176 extends through a lower portion of the mass 171, to one side of the slot 172, to receive a respective selector rod 161 or 162. An opposite lower portion 177 of the mass 171 is downwardly tapered to facilitate insertion between adjacent spacers 155 on the cradle 150. Large openings 178 and 179 extend through the mass 171 to make it weigh one-half as much as the plates 140 despite the similar configuration.

In a preferred mode of operation, the half-weight plates 170 are substituted for the weight plates 140 nearest each end of the base member 110. When a multiple of ten pounds is desired, the half-weight plates 170 are left in the cradle 150 and cooperate with the handle assembly to provide the first ten pounds of weight. Each turn of the knob 114 then adds ten additional pounds of weight. When a multiple of five pounds which is not also a multiple of ten pounds is desired, the half-weights 170 are removed from the cradle 150, leaving the five pound handle assembly and weights 140 to be added in ten pound increments with each turn of the knob 114. The size and placement of the opening 179 provides a convenient handle for handling the plate 170. Depending on design preferences, five pound weights may be configured like the half-weight plates 170, for insertion downward into the cradle 150 in place of the half-weight plates 170 (so that a weight of fifty-five pounds is still available).

Figure 10:
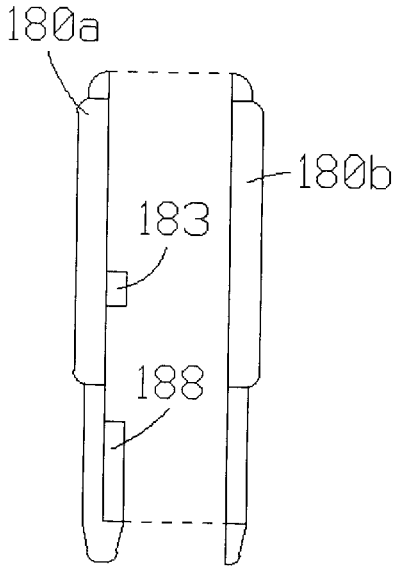
FIG. 10 is a side view of the plate of FIG. 9.
Figure 9:
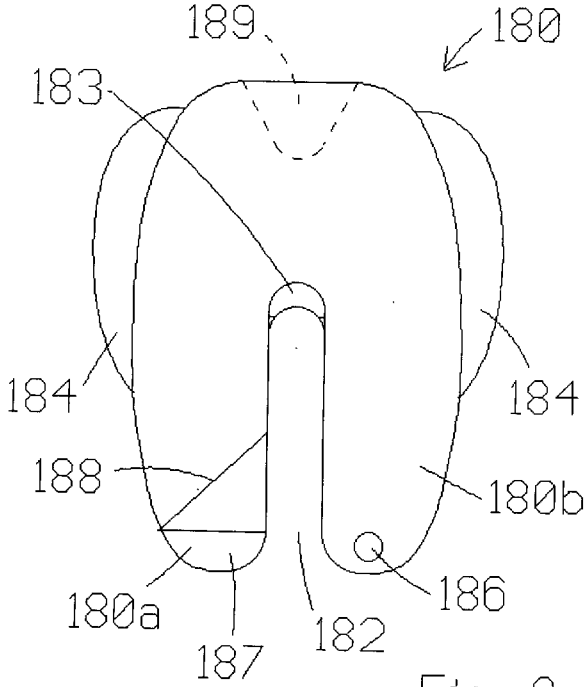
FIG. 9 is an end view of a bifurcated weight plate suitable for use with the assembly of FIG. 1.
Figure 14:
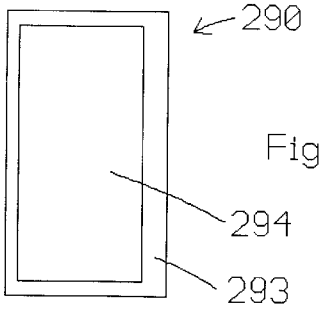
FIG. 14 is a top view of a box on the base assembly of FIG. 11.
Figure 11:
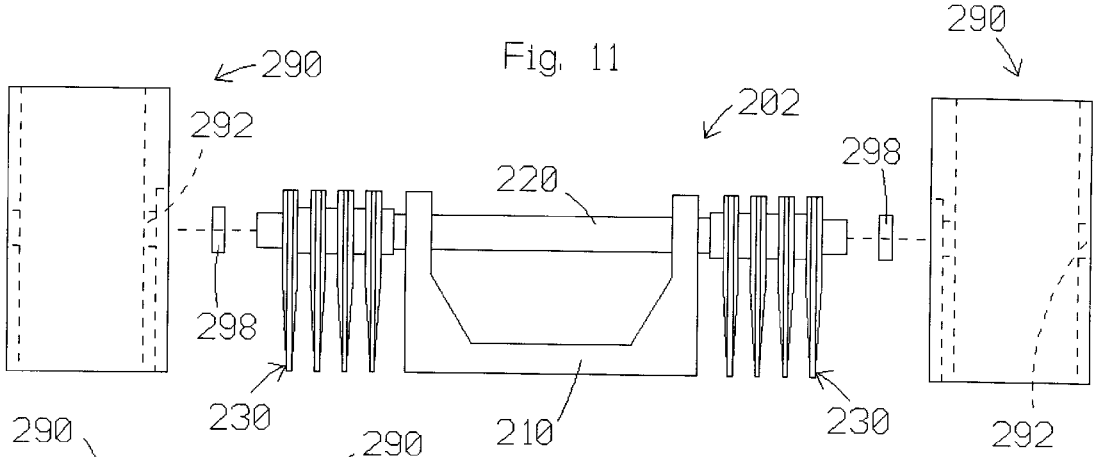
FIG. 11 is an exploded side view of an alternative base assembly which may be substituted for the base assembly of FIG. 3 on the dumbbell assembly of FIG. 1.
Figure 13:
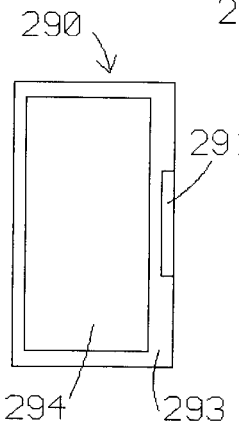
FIG. 13 is a bottom view of a box on the base assembly of FIG. 11.
Figure 12:
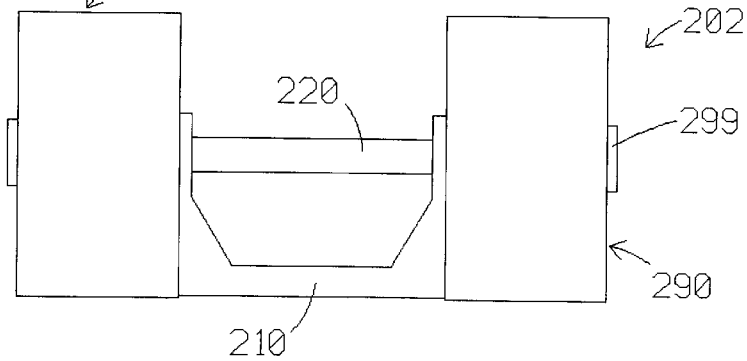
FIG. 12 is a side view of the assembled base assembly of FIG. 11.
Figure 18:
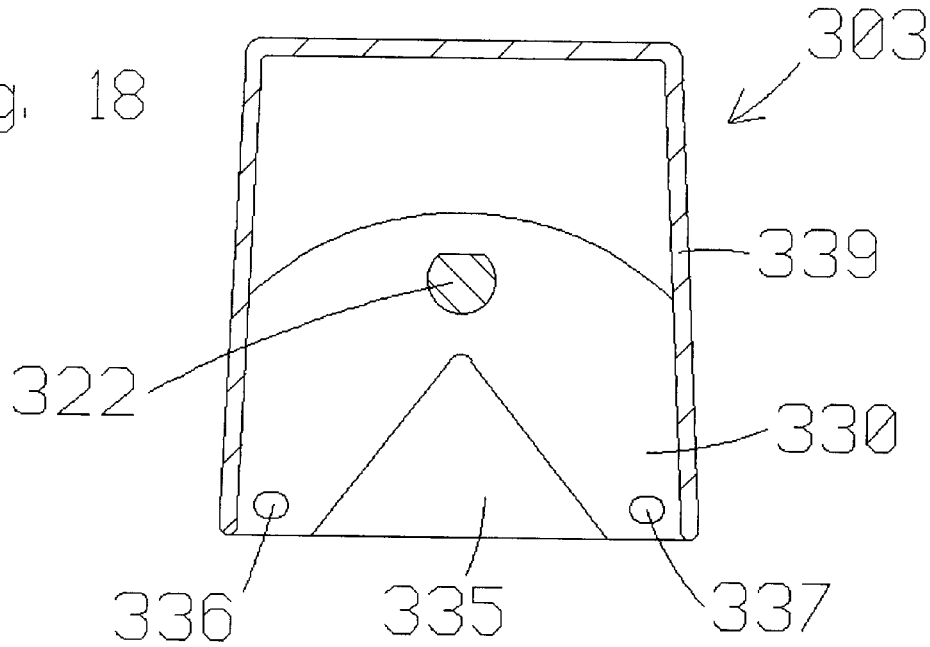
FIG. 18 is a sectioned end view of the base assembly of FIG. 16.

FIGS. 9–10 show another weight plate 180 which is sized and configured to replace any of the plates 140 in the assembly 100, and which also facilitates weight adjustments in increments of five pounds. The plate 180 includes first and second masses 180*a* and 180*b* that selectively mate to form a generally U-shaped mass which is sized and configured to fit between adjacent spacers 130*a* (and 130*b* at the ends). In general, each of the masses 180*a* and 180*b* is one-half as thick as any of the plates 140.

Like the plate 170, each mass 180*a* and 180*b* is provided with a downwardly opening, elongate slot which is sized and configured to receive the handle 120. Relatively thicker ears or shoulders 184 are provided on an outward side of each mass 180*a* and 180*b* to establish a proximal relationship between the plate 180 and any adjacent plate 140. A hole 186 extends through a lower portion of each mass 180*a* and 180*b,* to one side of the elongate slot, to receive a respective selector rod 161 or 162. The mass 180*a* has an opposite lower portion which is the same thickness as any of the plates 140, and which similarly terminates in a downwardly tapered region 187 that facilitates insertion between adjacent spacers 155 on the cradle 150. The mass 180*b* terminates at interface 188 and thus, has no comparable lower portion opposite the hole 186. An offset or shoulder 183 extends axially from the mass 180*a,* just above its elongate slot 182, to make this region of the mass 180*a*as thick as any of the weights 140. The elongate slot on the mass 180*b* is longer than the elongate slot 182 on the mass 180*a* to accommodate the offset 183 when the two masses 180*a* and 180*b* are mated with one another.

In a preferred mode of operation, half-weight plates 180 are substituted for the weight plates 140 nearest the base member 110, preferably with the masses 180*a* nearer the base member 110 and the offsets 183 extending away from the base member 110. When a multiple of ten pounds is desired, the masses 180*b* are removed from the cradle 150, and the masses 180*a* cooperate with the handle assembly to provide the first ten pounds of weight. The relatively thicker portions of each mass 180*a* are supported on opposite sides to stabilize the relatively thinner masses 180*a*.Each turn of the knob 114 adds ten additional pounds of weight. When a multiple of five pounds which is not also a multiple of ten pounds is desired, the masses 180*b* are inserted into the cradle 150, providing a ten pound increment comparable to any pair of the weights 140. A notch 189 is provided in the top of each mass 180*a* to provide convenient access to each mass 180*b* and/or to compensate for the additional mass at the lower end of each mass 180*a*.

FIGS. 11–14 show components of an alternative embodiment dumbbell assembly which is operationally similar to the first assembly 100 but provides a range of greater weight amounts. This alternative assembly similarly includes a base member 210, a handle 220, and spacers 230 which cooperate to provide a base assembly 202 capable of selectively lifting generally U-shaped weights out of a cradle. However, the spacers 230 are reversed relative to those on the first assembly 100, so the offsets extend toward the base member 210, and the innermost and outermost spacers have been replaced by opposite end walls of open ended boxes 290 and annular spacers 298.

Each box 290 is made of steel and may be described as a rectangular shell having a relatively thicker wall 293 proximate the base member 210. Each box 290 defines a compartment 294 which is accessible from above and below. A downwardly opening notch 291 is formed in the relatively thicker wall 293 to accommodate a respective edge of the base member 210. A bore 292 extends through each of the end walls to receive the handle 220.

Each side of the base assembly 202 is assembled by inserting a distal handle end through the relatively thicker wall 292 on a respective box 290, then through the four spacers 230, then through an annular spacer 298, and then through the opposite end wall on the box 290. A bolt 299 or other suitable fastener is then secured to the end of the handle 220 to retain the box 290 in place. The boxes 290 are sized and configured in such a manner that the spacers 230 remain free to engage the U-shaped weights in the same manner as the spacers on the first assembly 100. The base member 210, the handle 220, the spacers 230, and the boxes 290 are manufactured to collectively weigh fifty pounds. With the addition of one to five pairs of five pound weights, the assembly provides weights ranging from fifty pounds to one hundred pounds in ten pound increments. As on other embodiments disclosed herein, half-weight plates may be provided in a variety of different ways to facilitate weight changes in five pound increments.

FIGS. 15–20 show components of a dumbbell assembly 300 which is operationally similar to the foregoing assemblies and provides both ranges of weight increments. The assembly 300 similarly includes a base member 310, a handle 320, and spacers 330 which cooperate to define a base assembly or handle assembly 303 sized and configured to selectively lift generally U-shaped weights 340 out of a cradle 350. Both the base member 310 and the handle 320 are interconnected between opposite end boxes 339 which open downward to accommodate respective weight plates 340.

Figure 19:
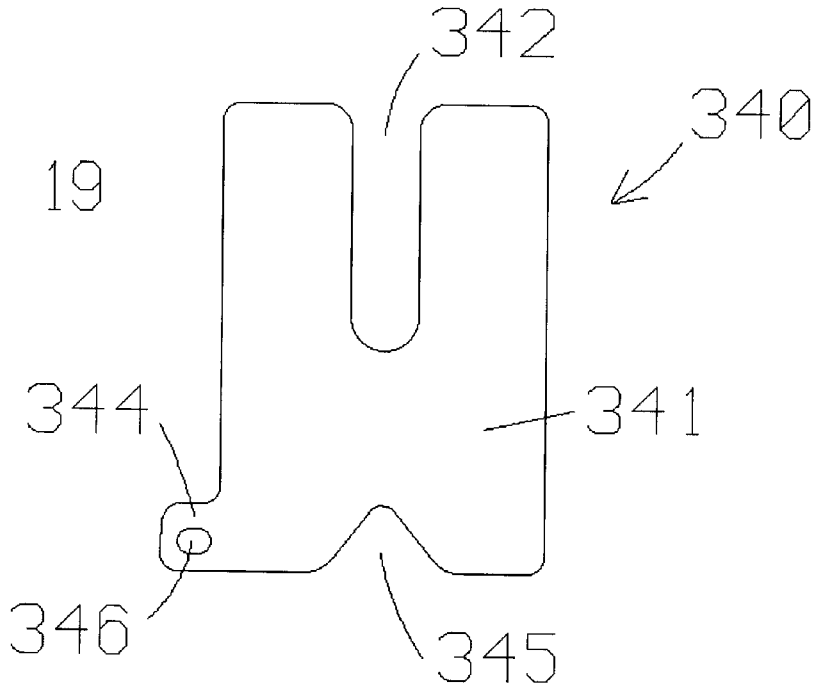
FIG. 19 is an end view of a weight plate which is a component of the assembly of FIG. 15.
Figure 20:
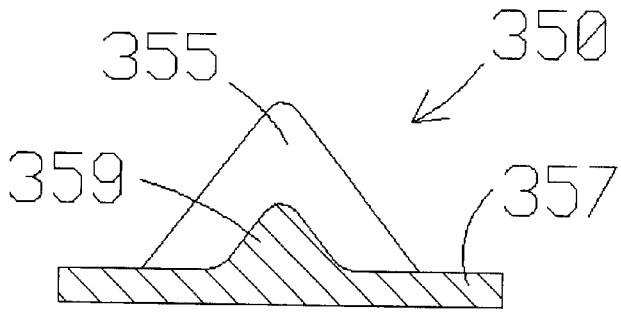
FIG. 20 is a sectioned end view of the cradle of FIG. 17.

One of the weight plates 340 is shown by itself in FIG. 19. The plate 340 is a generally U-shaped mass 341 which is sized and configured to fit between adjacent spacers 330 (and end walls of the boxes 339 in some cases). Each mass 341 is provided with an upwardly opening, elongate slot 342 which is sized and configured to receive the handle 320. Upper portions of each mass 341 may be rounded and/or upwardly tapered to provide relatively larger gaps between the tops of adjacent weights 340. The bottom of each mass 341 is provided with a notch 345 which is sized and configured to receive a central ridge 359 on the cradle 350. The bottom edge of the mass 141 may also be rounded and/or downwardly tapered to provide relatively larger gaps between the bottoms of adjacent weights 340. A tab 344 projects outward from the mass 341, to one side of the notch 345, and a hole 346 extends through the tab 344 to receive a respective selector rod 360.

The cradle 350 includes a base 357 having opposite end portions 351 and 352 and an intermediate portion 353. The ridge 359 has a triangular profile and extends the length of each of the end portions 351 and 352. Spacers 355 having a larger triangular profile extend upward from each end portion 351 and 352 of the base 357 to define slots 356 which are sized and configured to receive the weight plates 340. The intermediate portion 353 of the base 357 is sized and configured to accommodate the base member 310.

The handle 320 is a steel shaft having a central portion 321, which is preferably cylindrical in shape and provided with a knurled outer surface, and opposite end portions 322, which are preferably cylindrical in shape except for an axially extending flat surface. Each end portion 322 is inserted through a mating opening in a respective box 339 and secured against axially movement relative thereto.

Each spacer 330 is provided with an axially extending bore which is also sized and configured to receive an end portion 322 of the handle 320. The bores cooperate with respective handle portions 322 to lock the spacers 330 against rotation relative to the handle 320. On this embodiment 300, the spacers 330 are integrally connected to opposite sidewalls of respective boxes 339 to maintain proper axial spacing therebetween. A large notch 335 extends into the lower edge of each spacer 330 to accommodate an axially aligned spacer 355 on the cradle 350.

On each side of the notch 335, a relatively smaller, axially extending bore 336 or 337 extends through each spacer 330 to receive a respective selector rod 360. The bores 336 align with the holes 346 through the weights 340 on a first end of the assembly 300, and the bores 337 align with the holes 346 through the weights 340 on a second, opposite end of the assembly 300. As on the foregoing embodiments, each selector rod 360 is a steel bar provided with tapered ends and a rack of gear teeth extending therebetween. Each selector rod 360 is movably mounted within a respective set of bores 336 or 337 and interconnected by at least one gear which is rotatably mounted to the base member 310. A knob 314 is rigidly secured to the gear and rotatable to move the rods 360 back and forth. As on the foregoing embodiments, any of various known spring detent arrangements may be provided between the knob 314 and the base member 310 and/or between the base member 310 and any of the components of the rack and pinion assembly in order to bias the components to remain in desired orientations and/or positions relative to the base member 310.

The relative sizes and configurations of the weights 340 and the handle assembly 303 are such that a first selector rod 360 extends through the holes 346 in the weights 340 on a first end of the assembly 300, and the second selector rod 360 is disposed outside the weights 340 on the first end of the assembly 300. As a result, a portion of the second selector rod 360 may be stored in the holes 337 in the first end of the assembly 300 without interfering with the removal and return of the weights 340 on the first end. This arrangement allows the selector rods 360 to be considerably longer than those on the foregoing embodiments, and thereby eliminates a constraint on the size and number of available weights. For example, with a handle assembly 303 weighing ten pounds, and weight plates 340 weighing five pounds each, the depicted assembly 300 provides a dumbbell capable of weighing ten to one hundred pounds in ten pound increments.

Figure 21:
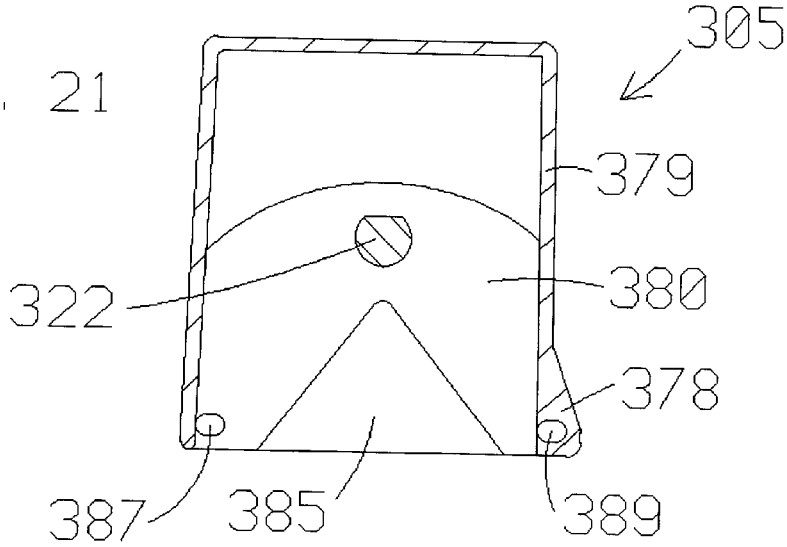
FIG. 21 is a partially sectioned end view of an alternative embodiment base assembly.
Figure 22:
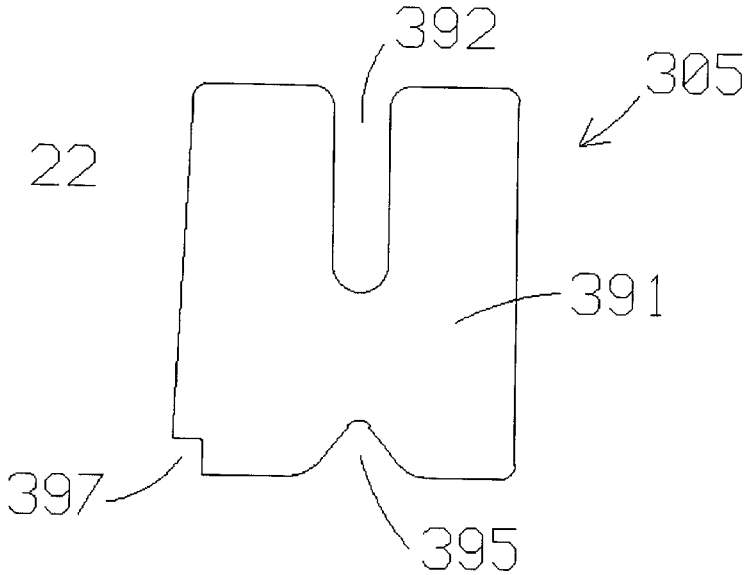
FIG. 22 is an end view of an alternative embodiment weight plate suitable for use with the alternative embodiment base assembly of FIG. 21.
Figure 23:
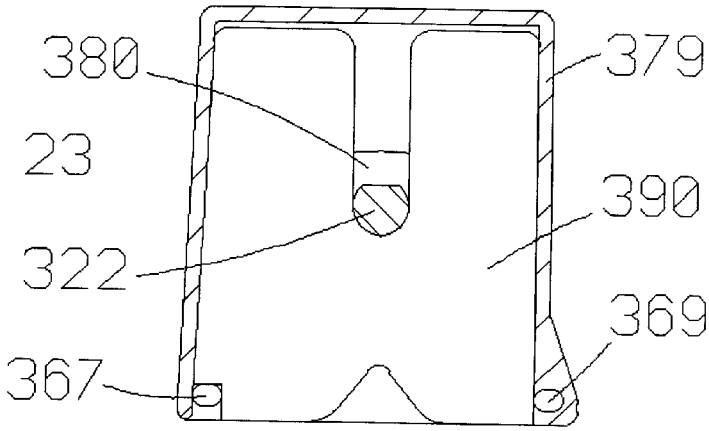
FIG. 23 is an end view of the weight plate of FIG. 22 inside the base assembly of FIG. 21.

FIGS. 21–23 show an alternative to the foregoing embodiment 300, with base assembly 305 and weight plates 390 configured differently than the base assembly 303 and the weight plates 340. The base assembly 305 includes the same handle 322 and a similar, but wider base member with selector rods 367 and 369 spaced further apart from one another. The base assembly 305 and the weight plates 390 are suitable for use on the cradle 350.

On each end of the handle 322, a box 379 provides a downwardly opening compartment which is spanned by axially spaced, interior walls 380. The handle 322 extends through each end of the box 379 and through each of the interior walls 380. A larger triangular notch 385 is extends upward into each of the interior walls 380 to accommodate a respective spacer 355 on the cradle 350. On one side of each box 379, a bore 387 extends through an end of the box 379 nearest the base member, and through each of the interior walls 380. On an opposite side of each box 379, a bore 389 extends through the end of the box 379 nearest the base member, and through a relatively thicker side wall portion 378 of the box 379.

As shown in FIG. 22, each weight 390 is a generally U-shaped mass 391 having an upwardly opening, elongate slot 392, which is sized and configured to receive the handle 322, and a downwardly opening, triangular notch 395, which is sized and configured to accommodate the ridge 359 on the cradle 350. A notch 397 is formed in a lower corner of the weight 397 to accommodate a respective selector rod 367.

FIG. 23 shows the weight 390 inside the box 379. The notch 397 aligns with the bore 387 and a respective selector rod 367. The other selector rod 369 is disposed outside an opposite side of the weight 390. When none of the weights 390 is selected, the selector rod 367 does not underlie the weight 390 shown in FIG. 23, and the selector rod 369 extends past the weight 390 shown in FIG. 23. In this configuration, the both selector rods 367 and 369 are free of the weight 390 shown in FIG. 23, and the base assembly 305 is free to move upward relative to same.

FIGS. 24–30 show components of a dumbbell assembly 400 which is similar in many respects to the foregoing assembly 300, but with a base member 410 disposed on a side of the assembly 400, as opposed to the base member 310 disposed on the bottom of the assembly 300 shown in FIG. 15. In addition to the base member 410, the assembly 400 similarly includes a handle 420, and spacers 430 which cooperate to define a base assembly or handle assembly 404 sized and configured to selectively lift generally U-shaped weights 440 out of a cradle 450. The base member 410, the handle 420, and a counterpart 408 to the base member 410 are interconnected between opposite end boxes 439 which open downward to accommodate respective weight plates 440.

Figure 30:
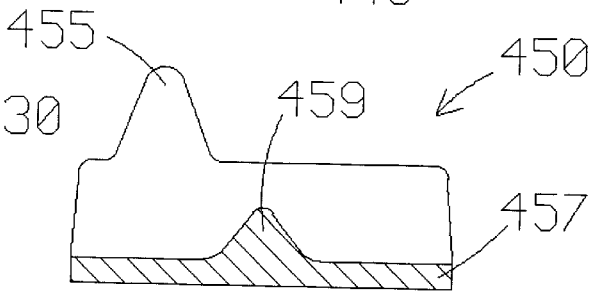
FIG. 30 is a sectioned end view of the cradle of FIG. 26.
Figure 34:
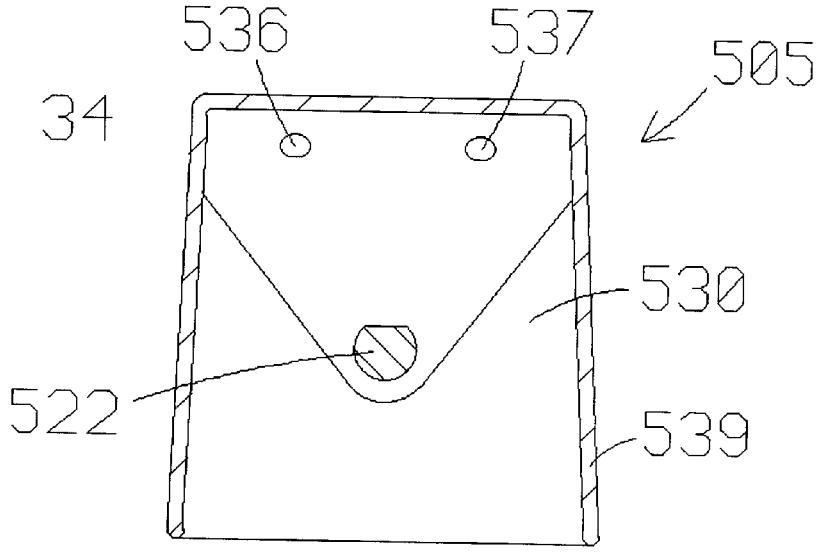
FIG. 34 is a sectioned end view of the base assembly of FIG. 32.

As shown in FIGS. 26 and 30, the cradle 450 includes a base 457 having opposite end portions 451 and 452 and an intermediate portion 453. A longitudinally extending ridge 459, having a triangular profile, spans each of the end portions 451 and 452. Spacers 455, having a relatively larger profile, extend upward from each end portion 451 and 452 of the base 457 to define slots 456 which are sized and configured to receive the weight plates 440. The intermediate portion 453 of the base 457 is sized and configured to accommodate the base member 410.

Figure 29:
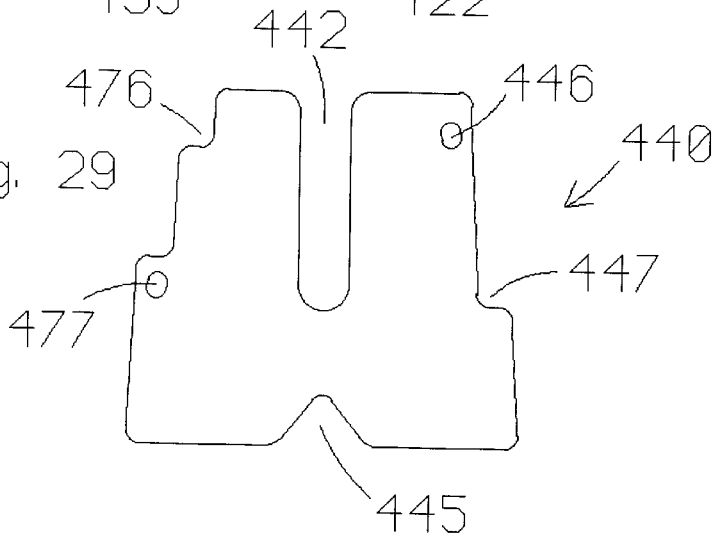
FIG. 29 is an end view of a weight plate which is a component of the assembly of FIG. 24.

As shown in FIG. 29, each weight plate 440 is a U-shaped mass 441 which is sized and configured to fit between adjacent spacers 430 (and end walls of the boxes 439 in some cases). The mass 441 is provided with an upwardly opening, elongate slot 442 which is sized and configured to receive the handle 420. Upper portions of each mass 441 may be rounded and/or upwardly tapered to provide relatively larger gaps between the tops of adjacent weights 440. The bottom of each mass 441 is provided with a notch 445 which is sized and configured to receive the central ridge 459 on the cradle 450. The bottom edge of each mass 441 may also be rounded and/or downwardly tapered to provide relatively larger gaps between the bottoms of adjacent weight plates 440.

Since the base member 410 is disposed along one side of the assembly 400, only a corresponding side of each plate 440 need be configured to cooperate with the selector rods 466 and 467. However, plate 440 is configured with a first side suitable for use at one end of the assembly 400, and an opposite, second side suitable for use at the other end of the assembly 400. As on the other embodiments, the opposite side weights are simply "flipped around" relative to one another.

With respect to a first end of the assembly 400, overlying the first end portion 451 of the cradle 450, a notch 447 is provided in the first side of the plate 440 to accommodate the lower selector rod 467. As a result, when the selector rod 467 spans the first side of the plate 440, the handle assembly 404 remains free to move upward relative to the plate 440. On the same first end of the assembly 400, a hole 446 extends axially through an upper portion of the plate 440, proximate the first side thereof, to receive the upper selector rod 466.

As a result, when the selector rod 466 extends through the hole 446 in the plate 440, the plate 440 is constrained to move together with the handle assembly 404.

With respect to an opposite, second end of the assembly 400, overlying the second end portion 452 of the cradle 450, a notch 476 is provided in the opposite, second side of the plate 440 to accommodate the upper selector rod 466. As a result, when the selector rod 466 spans the second side of the plate 440, the handle assembly 404 remains free to move upward relative to the plate 440. On the same, second end of the assembly 400, a hole 477 extends axially through an upper portion of the plate 440, proximate the second side thereof, to receive the lower selector rod 467. As a result, when the selector rod 467 extends through the hole 477 in the plate 440, the plate 440 is constrained to move together with the handle assembly 404.

The handle 420 is a steel shaft having a central portion 421, which is preferably cylindrical in shape and provided with a knurled outer surface, and opposite end portions 422, which are preferably cylindrical in shape except for an axially extending flat surface. Each end portion 422 is inserted through a mating opening in a respective box 439 and secured against axially movement relative thereto.

Figure 27:
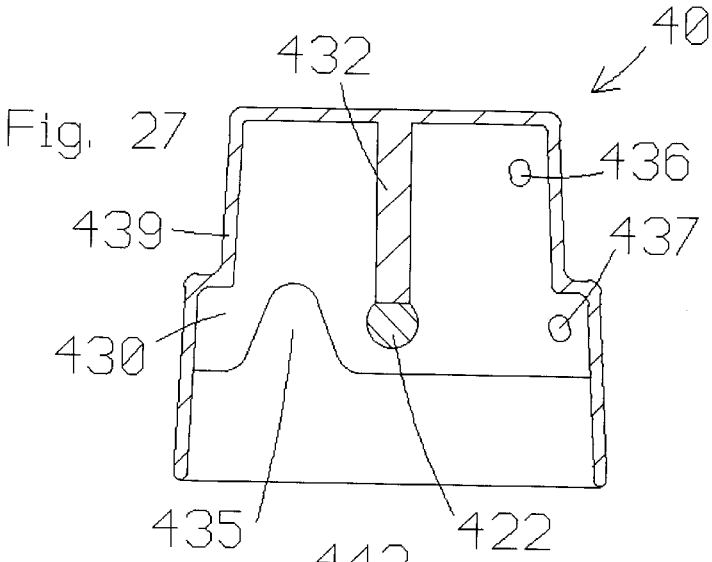
FIG. 27 is a sectioned end view of an end portion of the base assembly of FIG. 25.
Figure 28:
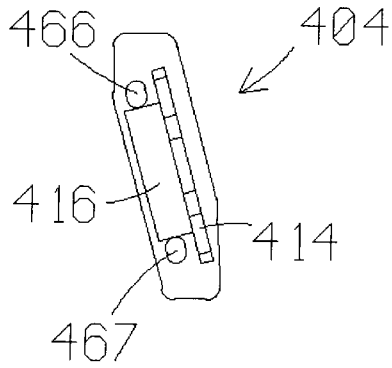
FIG. 28 is an end view of an intermediate portion of the base assembly of FIG. 25.

As shown in FIGS. 25 and 27, each spacer 430 is provided with an axially extending bore which is also sized and configured to receive an end portion 422 of the handle 420. The bores cooperate with respective handle portions 422 to lock the spacers 430 against rotation relative to the handle 420. A reinforcing rib 432 extends the length of each box 439, above respective handle portions 422, and the spacers 430 are integrally connected to both the rib 432 and the opposite sidewalls of respective boxes 439 to maintain proper axial spacing. A notch 435 extends into the lower edge of each spacer 430 to accommodate an axially aligned spacer 455 on the cradle 450.

On a side of each spacer 430 in alignment with the base member 410, relatively smaller, axially extending bores 436 and 437 extend through each spacer 430 to receive selector rods 466 and 467. The bores 436 align with the holes 446 through the plates 440 that are supported at the first end 451 of the cradle 450 and also, with the notches 476 in the plates 440 that are supported at the second end 452 of the cradle 450. The bores 437 align with the notches 447 in the plates 440 that are supported at the first end 451 of the cradle 450 and also, with the holes 477 through the plates 440 that are supported at the second end 452 of the cradle 450.

As on the foregoing embodiments, each selector rod 466 and 467 is a steel bar provided with tapered ends and a rack of gear teeth extending therebetween. As shown somewhat diagrammatically in FIG. 28, each selector rod 466 and 467 is movably mounted within a respective set of bores 436 or 437 and interconnected by at least one gear which is rotatably mounted to the base member 410. A knob 414 is rigidly secured to the gear and rotatable to drive the rods 466 and 467 back and forth. A recessed area 412 is provided in the base 410 to accommodate the knob 414 and a user's fingers. As on the other embodiments, any of various known spring detent arrangements may be provided between the knob 414 and the base member 410 and/or between the base member 410 and any of the components of the rack and pinion assembly in order to bias the components to remain in desired orientations and/or positions relative to the base 410 member.

The relative sizes and configurations of the weights 440 and the handle assembly 404 are such that a portion of the first selector rod 466 may be stored in the holes 436 in the second end of the assembly 400 without interfering with the removal of the weight plates 440 and/or return of the handle assembly 404 relative to the second end. Similarly, a portion of the second selector rod 467 may be stored in the holes 437 in the first end of the assembly 400 without interfering with the removal of the weight plates 440 and/or return of the handle assembly 404 relative to the first end. This arrangement allows the selector rods 466 and 467 to be considerably longer than those on the embodiments 100 and 200, and thereby eliminates a constraint on the size and number of available weights. As on the previous embodiment 300, with a handle assembly 404 weighing ten pounds, and weight plates 440 weighing five pounds each, the depicted assembly 400 provides a dumbbell capable of weighing ten to one hundred pounds in ten pound increments.

FIGS. 31–36 show still another "box" version 500 of the present invention, in this case with a base member 510 extending across the top of the assembly 500. In addition to the base member 510, the assembly 500 similarly includes a handle 520 and spacers 530 which cooperate to define a base assembly or handle assembly 505 sized and configured to selectively lift generally U-shaped weights 540 out of a cradle 550. The base member 510 and the handle 520 are interconnected between opposite end boxes 539 which open downward to accommodate respective weight plates 540. A possible disadvantage of this embodiment 500 is that a person cannot reach straight down to remove and/or return the handle assembly 505 relative to the cradle 550. On the other hand, this particular embodiment 500 includes the weight plates 540 are of simple construction and the knob 514 is readily accessible.

Figure 35:
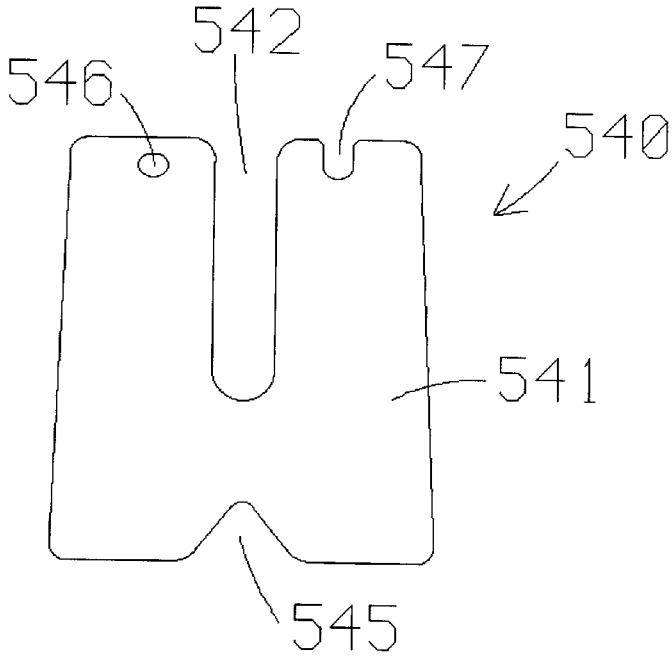
FIG. 35 is an end view of a weight plate which is a component of the assembly of FIG. 31.

As shown in FIG. 35, each of the weight plates 540 is a generally U-shaped mass 541 which is sized and configured to fit between adjacent spacers 530 (and end walls of the boxes 539 in some cases). Each mass 541 is provided with an upwardly opening, elongate slot 542 which is sized and configured to receive the handle 520. Upper portions of each mass 541 may be rounded and/or upwardly tapered to provide relatively larger gaps between the tops of adjacent weights 540. The bottom of each mass 541 is provided with a notch 545 which is sized and configured to receive a central ridge 559 on the cradle 550. The bottom edge of the mass 541 may also be rounded and/or downwardly tapered to provide relatively larger gaps between the bottoms of adjacent weights 540. A hole 546 is formed through each mass 541, on one side of the slot 542, to receive the selector rod 560 for engaging the plate 540. A notch 547 extends downward into each mass 541, on an opposite side of the slot 542, to accommodate the selector rod 560 for engaging plates 540 on an opposite side of the base member 510.

Figure 36:
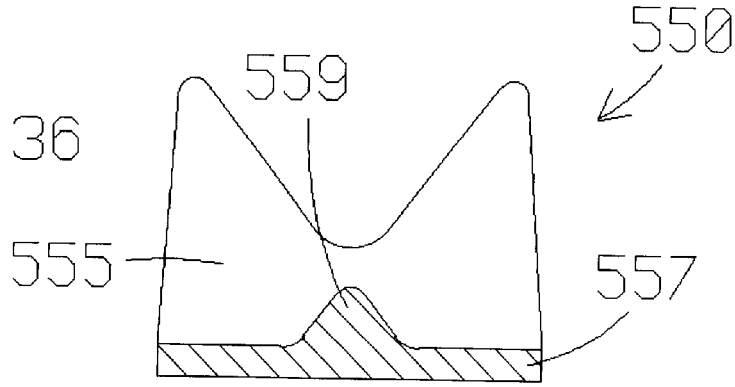
FIG. 36 is a sectioned end view of the cradle of FIG. 33.

As shown in FIGS. 32 and 36, the cradle 550 includes a base 557 having opposite end portions 551 and 552 and an intermediate portion 553. The ridge 559 has a triangular profile and extends the length of each of the end portions 551 and 552. Spacers 555 having a larger V-shaped profile extend upward from each end portion 551 and 552 of the base 557 to define slots 556 which are sized and configured to receive the weight plates 540. The intermediate portion 553 of the base 557 is sized and configured to accommodate the base member 510.

The handle 520 is a steel shaft having a central portion 521, which is preferably cylindrical in shape and provided with a knurled outer surface, and opposite end portions 522, which are preferably cylindrical in shape except for an axially extending flat surface. Each end portion 522 is inserted through a mating opening in a respective box 539 and secured against axially movement relative thereto.

Each spacer 530 is provided with an axially extending bore which is also sized and configured to receive an end portion 522 of the handle 520. The bores cooperate with respective handle portions 522 to lock the spacers 530 against rotation relative to the handle 520. The spacers 530 are integrally connected to both the top wall and opposite sidewalls of respective boxes 539 to maintain proper axial spacing therebetween. The spacers 530 are configured to complement the configuration of the axially aligned spacers 555 on the cradle 550.

Proximate the top of each box 539, relatively smaller, axially extending bores 536 and 537 extend through each spacer 530 to receive selector rods 560. The bores 536 align with the holes 546 through the weights 540 on a first end of the assembly 500, and with the notches 547 in the weights 540 on a second, opposite end of the assembly 500. The bores 537 align with the notches 547 in the weights on the first end of the assembly 500, and with the holes 546 through the weights 540 on the second end of the assembly 500.

As on the foregoing embodiments, each selector rod 560 is a steel bar provided with tapered ends and a rack of gear teeth extending therebetween. Each selector rod 560 is movably mounted within a respective set of bores 536 or 537 and interconnected by at least one gear which is rotatably mounted on the base member 510. As on the foregoing embodiments, any of various known spring detent arrangements may be provided between the knob 514 and the base member 510 and/or between the base member 510 and any of the components of the rack and pinion assembly in order to bias the components to remain in desired orientations and/or positions relative to the base member 510. The knob 514 is rigidly secured to the gear and rotatable to move the rods 560 back and forth. A recessed area 512 is provided in the base member 510 to accommodate the knob 514 and a person's fingers.

FIGS. 37–41 show yet another dumbbell assembly constructed according to the principles of the present invention. The dumbbell assembly 600 includes a base member 610, a handle 620, and weight members 640*a*–640*e*. The base member 610 is rigidly interconnected between upper ends of opposite side walls 612. Opposite, lower ends of the sidewalls 612 are interconnected by bars 624 which extend therebetween. A central portion of each sidewall 612 is rigidly secured to a respective end of the handle 620. The resulting assembly 606 is operable to selectively engage a desired number of weight members 640*a*–640*e*.

Each of the weight members 640*a*–640*e* includes a first plate 641, a second plate 642, and a respective pair of equal length connector rods 644*a*–644*e* rigidly interconnected therebetween. The rods 644*a* are relatively short, and the weight member 640*a* is disposed between the plates 641 and 642 on the other weight members 640*b*–640*e*. The rods 644*e* are relatively long, and the plates 641 and 642 on the weight member 640*e* are disposed outside the other weight members 640*a*–640*d*. The rods 644*b*–644*d* and the plates 641 and 642 on the weight members 640*b*–640*d* fall in between these two extremes.

An end view of the weight member 640*e* is shown in FIG. 40. The connector rods 644*e* extend away from the plate 641 shown in FIG. 40 and toward the "opposite side" plate 642. An axially extending spacer may be disposed on each of the plates 641 and 642 to maintain desired spacing between respective plates 641 and 642 and/or to guide the weight members 640*a*–640*e* into nested relationship relative to one another. The connector rods 644*a*–644*e* may be downwardly tapered to encourage their proper return relative to their counterparts on any "unselected" weight members. A hole 646 extends through each of the plates 641 to selectively receive a first selector rod 661. A similar hole extends through each of the plates 642 to receive a second selector rod 662.

As shown in FIG. 39, the selector rods 661 and 662 are movably mounted on the base member 610. Gear teeth are provided along a "rack" portion of each selector rod 661 and 662. A rotary gear 664 is rotatably mounted on the base member 610 and disposed between the rack portions of the selector rods 661 and 662. The gear or pinion 664 constrains the selector rods 661 and 662 to move in opposite directions, through openings in the side members 612 which are aligned with respective holes in the plates 641 and 642.

A knob 614 is secured to the gear 664 and rotatable together therewith relative to the base member 610. Inwardly directed notches 618 are provided about the circumference of the knob 614, at circumferentially spaced locations aligned with indicia 616 on the knob 614. A spring loaded latch member 619 is mounted on the base member 610 and operable to selectively engage any of the notches 618. The latch 619 may include any known mechanism suitable for cooperating with the notches 618 to bias the knob 614 toward discrete orientations relative to the base member 610. In other words, the knob 614 is designed to "click" into discrete orientations like a channel selector knob on an early model television set.

The markings 616 on the knob 614 indicate how much weight is currently selected. For example, when the notch associated with the indicia "10" is engaged, as shown in FIG. 37, the leading ends of the selector rods 661 and 662 extend only into the side walls 612. In this configuration, none of the weight members 640*a*–640*e* is selected, and the base assembly 606 alone is movable for exercise purposes. When the notch associated with the indicia "60" is engaged, the leading ends of the selector rods 661 and 662 terminate in respective plates 641 and 642 on the weight member 640*e*. In this configuration, all of the weight members 640*a*–640*e* are selected and movable together with the base assembly 606 for exercise purposes.

An advantage of this embodiment 600 is that the assembly is self-aligning and thus, does not require a dedicated housing to keep the individual weights properly positioned. The foregoing embodiment 600 may be modified to accommodate more weight by providing for storage of the selector rods in the "opposite side" weight plates (in a manner similar to the assembly 500 discussed above and shown in FIGS. 31–36). The foregoing embodiment 600 may also be modified to reduce the size of the selector rods and/or provide additional support for the weight members. For example, the holes in the plates may be replaced by relatively larger notches which receive respective fixed members which extend axially outward from the sidewalls. The fixed members and the notches would cooperate to form keyways sized and configured to receive the selector rods. In this manner, shear force would be distributed across a greater cross section of the selector rod.

The embodiment 600 may also be modified to provide smaller incremental changes in the weight to be lifted. For example, FIG. 41 shows a half-weight plate 670 which weighs two and one-half pounds (approximately one-half as much as the weight member 640*c*). The half-weight plate 670 is a U-shaped mass 671 which is sized and configured to fit between the base member 610 and the connector rods 644*a*–644*e*. An elongate slot 672 extends into one side of the mass 671 to accommodate the handle 620. Hook and loop type fasteners 677 are secured to the mass 671 to mate with complementary fasteners on either side wall 612. The weight 670 may be readily added or removed at the discretion of the user.

FIGS. 42–48 show still another dumbbell system constructed according to the principles of the present invention. The dumbbell assembly 700 includes a handle 720, a base member 710, first and second selector rods movably mounted on the base member 710, weight plates 740*a* and 740*b* (and 770*a* and 770*b* on the ends) selectively engaged by respective selector rods, and a cradle 750 to support the other components when not in use. As on the other embodiments, the selector rods are interconnected by at least one gear which is also movably mounted on the base member 710. A knob 714 is connected to the gear and provided with circumferentially distributed openings 717 to facilitate rotation of same. The handle 720 is sized and configured for grasping, and both the handle 720 and the base member 710 are rigidly interconnected between opposite side members 712. An advantage of this embodiment 700, as well as certain others, is that the handle 720 is accessible from above or either side of the assembly 700.

Figures 44, 45, 46:
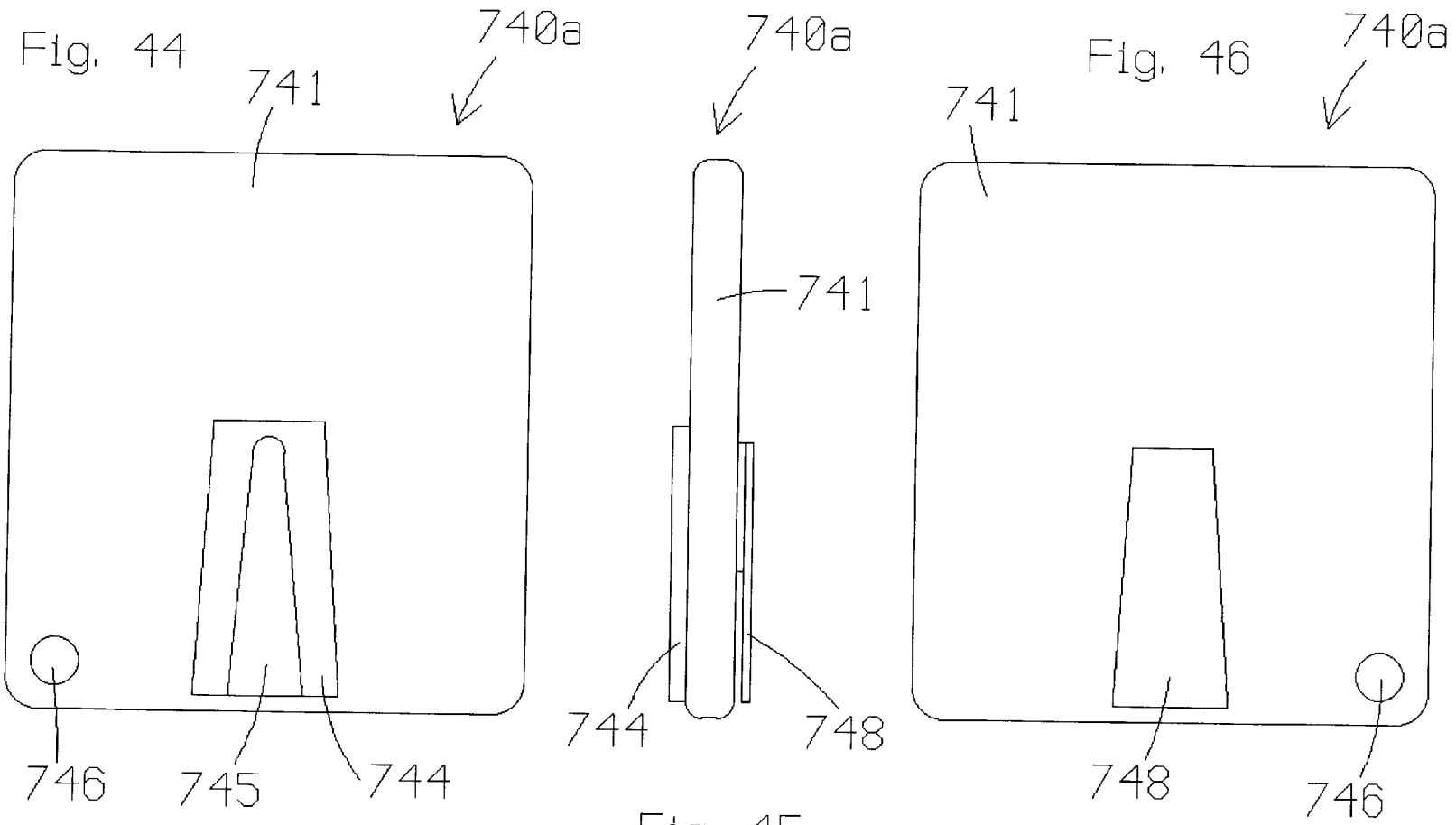
FIG. 44 is an end view of a weight plate which is a component of the assembly of FIG. 42.
FIG. 45 is a side view of the weight plate of FIG. 44.
FIG. 46 is an opposite end view of the weight plate of FIG. 44.

One of the "interior" weight plates 740*a* is shown in greater detail in FIGS. 44–46. The weight plates 740*b* are similar in configuration but rotated one hundred eighty degrees about the axis of rotation of the knob 714. The weight plate 740*a* is a square mass 741 having rounded edges. A hole 746 extends through the mass 741 (and a similar hole extends through a respective side member 712) to selectively receive a respective selector rod. A comparable hole extends through each of the weight plates 740*b* (and a similar hole extends through the other side member 712) to selectively receive the other selector rod.

Members 744 and 748 are mounted to opposite sides of each weight plate 740*a* and 740*b* to maintain proper spacing between same, and also, to interconnect the weight plates in a manner which discourages relative movement in a direction parallel to the handle 720 but does not interfere with upward movement of an inside weight relative to an adjacent outside weight. Each member 744 projects away from the handle 720 and provides a downwardly opening slot 745 having a T-shaped profile. Each member 748 projects toward the handle 720 and provides a T-shaped rail sized and configured to slide into a respective slot 745. A similar member 744 is also mounted on the outwardly facing surface of each side member 712 to receive the T-shaped rail on the innermost weight plate 740*a* or 740*b*. The end weight plates 770*a* and 770*b* are similar to the adjacent plates 740*a* and 740*b*, respectively, except they are not provided with members 744.

Figure 47:
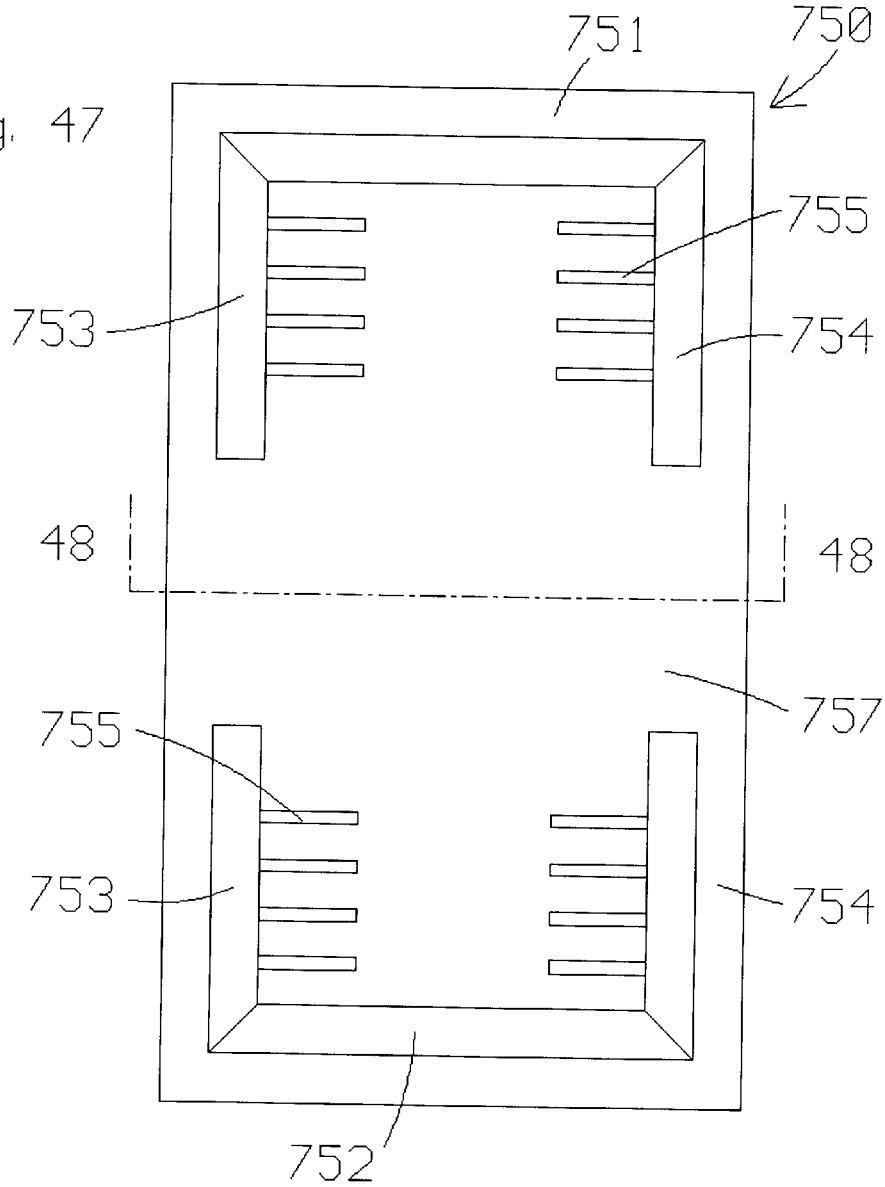
FIG. 47 is a top view of a cradle suitable for use with the assembly of FIG. 42.
Figure 48:
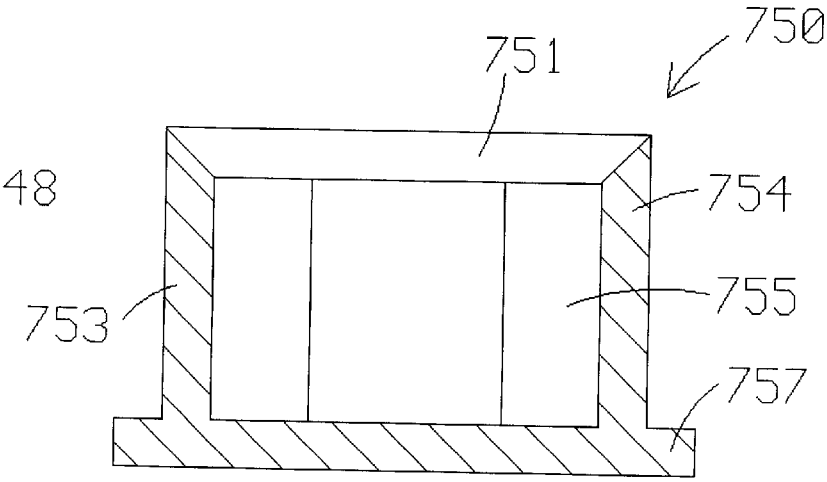
FIG. 48 is a partially sectioned end view of the cradle of FIG. 47.

As shown in FIGS. 47–48, the cradle 750 includes a flat base 757 and a pair of boxes extending upward therefrom to support the weight plates. The upper portion of each box is provided with downwardly convergent surfaces which encourage the weight plates into alignment with the boxes. The lower portion of each box includes opposing sidewalls 753 and 754 and a respective end wall 751 or 752 which cooperate to maintain the respective weight plates in a stable position. Flanges 755 extend inward from the sidewalls 753 and 754 at intervals sized and configured to receive the weight plates therebetween.

FIGS. 49–56 show still another dumbbell assembly constructed according to the principles of the present invention. The dumbbell assembly or system 800 includes a base member 810, a handle 820, and opposing side walls 812, all of which cooperate to define a base assembly or handle assembly which is operable to selectively lift a desired number of weight plates 840*a* and 840*b*. In this regard, selector rods 861 and 862 are constrained to move in opposite directions in response to rotation of knob 814. A cradle 850 supports the weight plates 840*a* and 840*b* in a position suitable for receiving the base assembly.

One of the weight plates 840*a* is shown by itself in FIGS. 52–56. The weight plates 840*a* and 840*b* are identical in configuration but face in opposite directions on the base assembly and in the cradle 850. Each of the weight plates 840*a* and 840*b*includes a U-shaped mass 841 which has a generally square perimeter and an elongate slot 842 extending downward from an upper edge of the mass 841. The slot 842 is sized and configured to receive the handle 820. A peg 844 extends upward from the base of the slot 842. The peg 844 is sized and configured to insert into a similarly configured bore 824 in the handle 820. The pegs 844 cooperate with the handle 820 to secure the weight plates 840*a* and 840*b* against axial movement relative to the handle 820. From a manufacturing perspective, a slot 849 may be provided in the top of the peg 844 to facilitate attachment to the mass 841 by means of a screwdriver.

Figures 52, 53, 54, 55, 56:
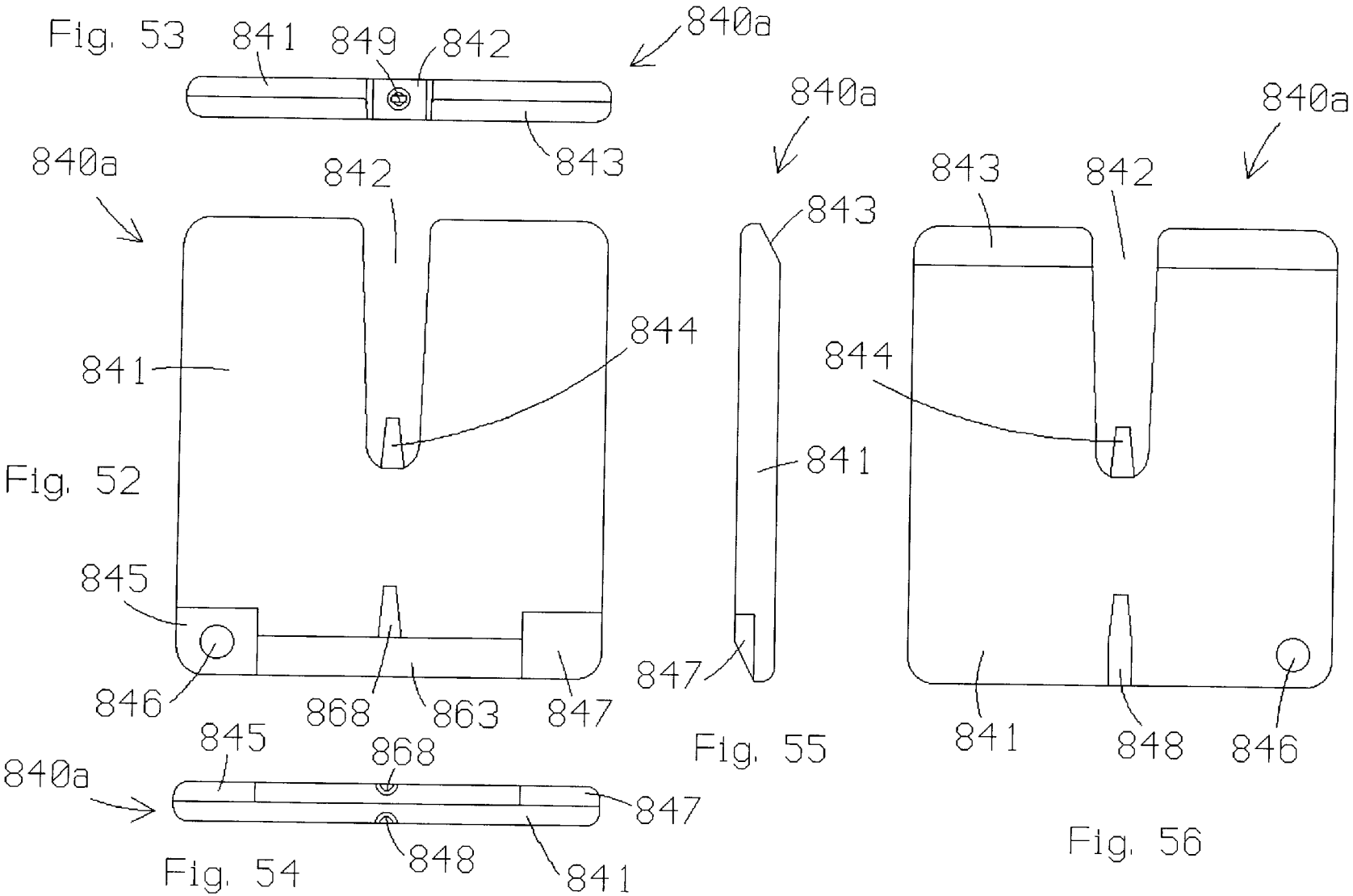
FIG. 52 is an end view of a weight plate which is a component of the assembly of FIG. 49.
FIG. 53 is a top view of the weight plate of FIG. 52.
FIG. 54 is a bottom view of the weight plate of FIG. 52.
FIG. 55 is a side view of the weight plate of FIG. 52.
FIG. 56 is an opposite end view of the weight plate of FIG. 52.

FIG. 56 shows a first side of the mass 841, which faces toward the base assembly. This inwardly facing side of the mass 841 has a beveled or tapered, upper end surface 843 which helps guide the base assembly (and any engaged weight plates) back into alignment with any weight plates remaining in the cradle 850. An opposite, lower end of this inwardly facing side is also provided with a centrally located notch 848 that extends upward from the bottom edge of the mass 841 to receive one-half of a similarly configured peg 858 on the cradle 850. A hole 846 extends axially through a lower corner of the mass 841 to receive a respective selector rod 861. The selector rods 861 and 862 cooperate with the handle 820 to secure the weight plates 840*a* and 840*b* against radial movement relative to the handle 820.

FIG. 52 shows a second, opposite side of the mass 841, which faces away from the base assembly. This outwardly facing side of the mass 841 has a beveled or tapered, lower end surface 863 which also helps guide the base assembly (and any engaged weight plates) back into alignment with any weight plates remaining in the cradle 850. Also, a centrally located notch 868 extends upward from the beveled surface 863 and into the outwardly facing side to receive a portion of a similarly configured peg 858 on the cradle 850. The lower corners of this outwardly facing side are provided with respective notches 845 and 847, and the hole 846 extends through the mass 841 proximate the center of the notch 845. The notches 845 provide gaps between adjacent weight plates 840*a* to facilitate proper indexing of the selector rod 861.

As shown in FIG. 51, the cradle 850 includes a base or bottom wall 857 and upwardly extending opposite side walls 854 (one of which is shown in FIG. 51). An intermediate portion of each side wall 854 is notched to proved access to the base assembly. At each end of the cradle 850, pegs 858 extend upward from the bottom wall 857, intermediate the side walls 854, to support any weight plates 840*a* and 840*b* not currently in use. As discussed above, each of the weight plates 840*a* and 840*b* is configured to insert between two adjacent pegs 858.

FIGS. 57–58 show an alternative base assembly 909 and an alternative weight plate 940*a* which are similar in some respects to their counterparts on the foregoing embodiment 800. The base assembly 909 includes a base member 910 which supports a rack and pinion arrangement in the same manner as one or more other embodiments. The same knob 814 is rotatably mounted on the base member 910 and operable to actuate the selector rods. The base member 910 is rigidly interconnected between lower ends of respective weight supports 930*a* and 930*b*. The same handle 820 extends through each of the weight supports 930*a* and 930*b*, and end caps 928 are mounted on each end of the handle 820 to retain the weight supports 930*a* and 930*b* in place.

On the far side of the weight support 930*a* (from the perspective of someone viewing FIG. 57), rod supports 934 project outward from an axially extending strip. Holes 936 extend axially through the rod supports 934 to receive a respective selector rod. With the exception of the rod support nearest the base member 910, the rod supports 934 are spaced sufficiently far apart to receive two weight plates 940a therebetween. In part, this "every other weight plate" spacing of the rod supports 934 is intended to emphasize that their effect on the spacing of the weight plates is not critical in this embodiment 909. In this regard, the weight plates 940*a* are provided with pegs which interact with holes in the handle 820 as on the previous embodiment 800. In fact, the only difference between the weight plate 840*a* and the weight plate 940*a* is that the latter has opposite side notches 945 and 947 which extend the entire height of the weight plate 940*a*.

FIGS. 59–61 show another base assembly 959 which is also similar in some respects to its counterpart on the foregoing embodiment 800. The base assembly 959 includes a base member 960 which supports a rack and pinion arrangement in the same manner as one or more other embodiments. The same knob 814 is rotatably mounted on the base member 960 and operable to actuate the selector rods. The base member 960 is rigidly interconnected between lower ends of respective weight supports 980*a* and 980*b*. The same handle 820 extends through each of the weight supports 980*a* and 980*b*, and the end caps 928 are mounted on each end of the handle 820 to retain the weight supports 980*a* and 980*b* in place.

The weight supports 980*a* and 980*b* have rod supports 984 which project outward from an axially extending side wall. Holes 986 extend axially through the rod supports 984 to receive a respective selector rod. The rod supports 984 are spaced in the same manner as the rod supports 934 on the previous embodiment 909. Those skilled in the art will recognize that rod supports could be provided on a "per weight plate" basis, in which case the pegs 844 could be eliminated. FIG. 61 shows a downwardly facing, flat surface 826 on each end of the handle 820. The flat surface 826 facilitates formation of the holes 824 in the handle 820 and better spacing between the pegs 844 and the walls of the slot 842.

The foregoing description and accompanying drawings show a variety of embodiments and/or features of the present invention, and it is to be understood that various features may be substituted for one another and/or combined with one another to arrive at numerous additional embodiments of the present invention. For example, to the extent compatible with operational constraints, the contouring described with reference to the weight plate 140 (shown in FIG. 4) may be applied to the weight plates on other embodiments. Also, the half-weight option(s) described with reference to a particular embodiment may be applied to other embodiments, as well. Weight may be added to many of the foregoing embodiments by adding a heavy box to each side of the dumbbell assembly, as described with reference to the assembly 202 shown in FIG. 12. The foregoing disclosure also shows how the selector rods may be stored entirely within the base member, and how the weights may be configured to accommodate the "opposite side" selector rod. Various arrangements are also disclosed for securing the weight plates against movement relative to one another and/or the handle assembly.

The foregoing disclosure may suggest additional features and/or embodiments, as well. For example, the selector rods may be operated by means of a knob which is selectively movable along its axis of rotation between a first position, wherein the knob is free to rotate, and a second position, wherein the knob is locked against rotation. One or more weight plate positions on a handle assembly may be configured to receive a module of fixed size but variable weight, thereby allowing a user to customize the range of weight available on the handle assembly at a given time. The spacers between the weight plates may be configured to function as leaf springs which would tend to pinch against the weight plates and/or reduce the possibility of rattling. The selector rods could move along grooves in relatively larger bars which span the available weight plates, and which cooperate therewith to define keyways for receiving the selector rods. In one case, the end portions of the handles could be configured to serve as the bars, and the selector rods could be movably mounted within the central portion of the handle.

Yet another design consideration is the width of the spacers disposed between the weights and/or the phase relationship between the selector rods. For example, the spacers could be made as wide as the weight plates, and the selector rods could be staggered, so that each incremental rotation of the knob causes only one of the selector rods to engage an additional weight plate, while the other selector rod moves into engagement with the next spacer. Still another design consideration is the configuration of the weight plates themselves. For example, those skilled in the art may recognize the desirability of making the an upper half or a lower half of the weights a different size, and/or locating the handle off center relative to the weights, perhaps to compensate for the weight of the selector rods and/or the portions removed from the upper portions of the weights. These two mass eccentricities may also be engineered to compensate for one another.

The present invention may also be described in terms of various methods, including, for example, a method of making an apparatus which provides adjustable resistance to exercise, comprising the steps of disposing weights on opposite first and second sides of a base assembly; movably mounting first and second bars on the base assembly; moving the first bar in a first direction and into engagement with a desired number of the weights on the first side of the base assembly; and contemporaneously moving the second bar in a second, opposite direction and into engagement with a desired number of the weights on the second side of the base assembly.

This method may further involve the steps of providing a hole through each of the weights on the first side of the base assembly to receive the first bar, and providing a hole through each of the weights on the second side of the base assembly to receive the second bar. Also, a groove may be provided in each of the weights on the first side of the base assembly to accommodate the second bar, and a groove may be provided in each of the weights on the second side of the base member to accommodate the first bar. The first bar and the second bar may be constrained to engage a like number of weights. Such constraints may involve provision of racks of gear teeth on the first bar and the second bar, and mounting of a rotary gear on the base assembly between the racks on the first bar and the second bar.

Such a method may also involve the step of maintaining each of the weights a fixed distance from the base assembly and/or maintaining each of the weights a fixed distance from adjacent weights. In this regard, weight spacers may be provided on the base assembly and/or on the weight plates themselves, and they may even extend between corresponding weights on opposite sides of the base assembly.

Further steps may include attaching a plastic support to each of the weights to facilitate engagement by a respective bar, and/or providing a housing sized and configured to accommodate the base assembly and the weights, and to support any non-engaged weights upon removal of the base member. To the extent that a handle protrudes outward from the sides of the base assembly, a groove may be provided in each of the weights to accommodate the handle. Also, the base assembly and the weights may be configured to collectively define keyways sized and configured to receive the first bar and the second bar. The weights may also be constrained to move through defined paths. Recognizing that persons skilled in the art are likely to recognize many such variations, the scope of the present invention is to be limited only to the extent of the following claims.

What is claimed is:

1. An exercise dumbbell system, comprising:

a base assembly including a handle having a longitudinal axis;

left and right weight plates disposed on opposite sides of said base assembly;

a first means, connected to said base assembly, for securing said weight plates against axial movement relative to said base assembly;

a second means, connected to said base assembly, for selectively securing a desired number of said weight plates against radial movement relative to said base assembly while said second means remains connected to said base assembly; and a knob rotatably mounted on said base assembly and connected to said second means in such a manner that said second means engages said desired number of weight plates in response to rotation of said knob.

2. The exercise dumbbell system of claim 1, wherein each of said weight plates has an upwardly opening slot sized and configured to receive said handle.

3. The exercise dumbbell system of claim 1, further comprising a cradle sized and configured to contain said weight plates.

4. The exercise dumbbell system of claim 1, wherein said second means includes first and second selector rods movably mounted on said base member and connected to said knob in such a manner that rotation of said knob causes said selector rods to move into engagement with said desired number of weight plates.

5. The exercise dumbbell system of claim 4, wherein said first means includes spacers fixed to said base assembly at intervals sufficiently large to receive said weight plates therebetween.

6. The exercise dumbbell system of claim 4, wherein said first means includes connector rods interconnected between corresponding pairs of said weight plates.

7. The exercise dumbbell system of claim 4, wherein said first means includes openings in said handle sized and configured to receive members on said weight plates.

8. The exercise dumbbell system of claim 4, wherein said first means includes interengaging structure on said weight plates.

9. The exercise dumbbell system of claim 1, wherein said first means includes spacers fixed to said base assembly at intervals sufficiently large to receive said weight plates therebetween.

10. The exercise dumbbell system of claim 1, wherein said first means includes connector rods interconnected between corresponding pairs of said weight plates.

11. The exercise dumbbell system of claim 1, wherein said first means includes openings in said handle sized and configured to receive members on said weight plates.

12. The exercise dumbbell system of claim 1, wherein said first means includes interengaging structure on said weight plates.

13. The exercise dumbbell system of claim 1, wherein said first means includes spacers fixed to said handle at intervals sufficiently large to receive said weight plates therebetween.

14. The exercise dumbbell system of claim 13, wherein said weight plates are configured to have outside portions which are relatively closer together and inside portions which are relatively farther apart, so that said spacers are encouraged to move downward between said inside portions.

15. The exercise dumbbell system of claim 1, wherein all of said weight plates are of equal mass.

16. The exercise dumbbell system of claim 1, wherein downwardly opening boxes are disposed on respective opposite sides of said base assembly.

17. The exercise dumbbell system of claim 1, wherein said weight plates are configured so that adjacent weight plates have first adjacent surfaces which are relatively close together and second adjacent surfaces which are relatively far apart.

18. A first weight plate and a second weight plate in combination with a dumbbell handle having axially spaced dividers, each weight plate comprising:

a main body having a mean thickness bounded by parallel flat surfaces, wherein the body is interrupted by an upwardly opening slot which extends parallel to the mean thickness;

shoulders protruding axially outward from at least one of the flat surfaces, along opposite edges of the body, wherein when the first weight plate is positioned adjacent weight plate with respective slots aligned, an upwardly opening cavity is defined between the body of the first weight plate, the body of the second weight plate, and the shoulders disposed therebetween, and the cavity is sized and configured to guide one of the dividers into a desired position between the first weight plate and the second weight plate.

19. The weight plate of claim 18, wherein an upper edge of the body, intermediate the shoulders, is upwardly tapered.

20. The weight plate of claim 18, wherein a lower edge of the body is downwardly tapered.

* * * * *